US009611065B2

(12) United States Patent
Franic

(10) Patent No.: US 9,611,065 B2
(45) Date of Patent: Apr. 4, 2017

(54) PACKAGING

(75) Inventor: Ivica Franic, Vienna (AT)

(73) Assignee: Elopak Systems AG, Glattbrugg (CH)

( * ) Notice: Subject to any disclaimer, the term of this patent is extended or adjusted under 35 U.S.C. 154(b) by 0 days.

(21) Appl. No.: 14/352,531

(22) PCT Filed: Aug. 29, 2012

(86) PCT No.: PCT/GB2012/051858

§ 371 (c)(1),
(2), (4) Date: Jul. 7, 2015

(87) PCT Pub. No.: WO2012/156763

PCT Pub. Date: Nov. 22, 2012

(65) Prior Publication Data

US 2016/0031587 A1 Feb. 4, 2016

(30) Foreign Application Priority Data

Oct. 18, 2011 (GB) ..... 1117986.8

(51) Int. Cl.
*B65D 5/06* (2006.01)
*B65D 5/74* (2006.01)

(52) U.S. Cl.
CPC ..... *B65D 5/067* (2013.01); *B65D 5/746* (2013.01)

(58) Field of Classification Search
CPC ..... B65D 5/067; B65D 5/746; B65D 5/029; B65D 3/08; B65D 5/745
USPC ..... D9/431; 229/125.42, 125.04, 213, 214
See application file for complete search history.

(56) References Cited

U.S. PATENT DOCUMENTS 5,152,438 A * 10/1992 Gordon ..... B29C 65/08 156/580.2
5,636,785 A * 6/1997 Kalberer ..... B65D 5/067 229/125.15
D623,537 S * 9/2010 Berman ..... D9/708

FOREIGN PATENT DOCUMENTS

EP 1055606 A2 11/2000
JP H061219 U 1/1994

* cited by examiner

*Primary Examiner* — Christopher Demeree
(74) *Attorney, Agent, or Firm* — Warn Partners, P.C.

(57) ABSTRACT

A container formed of a blank (2) consisting of first, second, third, fourth and fifth panels (4, 6, 8, 10, 12), respectively. The first, second, third, fourth and fifth panels (4, 6, 8, 10, 12) include respective top sealing sub-panels (14, 16, 18, 20, 22), of an outwardly bowed form bounded inwardly by respective score lines (15, 17, 19, 21, 23). The first, second, third, fourth and fifth panels (4, 6, 8, 10, 12) also include respective bottom sealing sub-panels (24, 26, 28, 32, 34) of a per se known form. The first and third panels (4, 8) also include respective intermediate panels (34,38) which are each uninterrupted by score lines, except that one intermediate sub-panel (38) is formed with a through hole (40) for receiving a pour spout fitment. The second and fourth panels (6, 10) include respective intermediate sub-panels (36, 40) which are divided by score lines into respective sub-sub-panels (42, 44), identically as between the sub-panels (36, 40).

19 Claims, 35 Drawing Sheets

PACKAGING

CROSS REFERENCE TO RELATED APPLICATIONS

This application is a National Stage of International Application No. PCT/GB2012/051858, filed Aug. 29, 2012. This application claims priority to Great Britain Patent Application No. GB 1117986.8 filed on Oct. 18, 2011. The disclosures of the above applications are incorporated herein by reference.

This invention relates to flat carton blanks, carton sleeves and cartons and to packaging methods.

WO2010/070121A2 discloses a gable top carton and a carton blank for forming the carton, and comprising first, second, third and fourth substantially four-edged panels, each comprising a bottom closure part, a side wall part, a top closure obturating part and a top sealing fin part. A front one of the panels is substantially free from any line of weakness extending inwardly from lateral edge zones of the front panel from an outermost boundary of its side wall part to an outermost boundary of its top sealing fin part. In a second embodiment the front panel is substantially free from any line of weakness extending inwardly from lateral edge zones of the front panel from an innermost boundary of its top closure obturating part to an outermost boundary of its top sealing fin part. The front of the top closure obturating part may include a loop of weakness for severing by a pour spout fitment to provide a pouring hole. Transition sub-panels may be provided between substantially triangular gable end parts and their adjacent side wall parts. In both embodiments, the top sealing fin may be substantially co-planar with the front obturating part. However, both embodiments are of substantially a traditional gable top carton appearance overall and it is desirable for a company supplying gable top carton sleeves, for example, to be able to offer to customers carton sleeves for gable top cartons of non-traditional appearance.

According to one aspect of the present invention, there is provided a container comprised of semi-rigid sheet material having a tubular main body and a gable-form part closing said body at one end thereof, said gable-form part comprising an outermost sealing fin, first and second diverging walls diverging inwardly from said fin relative to each other and whereof at least the first wall has complementarily outwardly curved inner and outer surfaces, the first wall further having a pour spout fitment attached thereto, first and second gable end walls each extending from the first to the second of said diverging walls and each having at least an upper part which is of substantially triangular outline as seen in end elevation, with an edge thereof at the inside surface of said first wall being curved and closely following the shape of that inside surface.

According to a second aspect of the present invention, there is provided a gable-top carton sleeve comprising a loop of first, second, third and fourth substantially four-edged panels, each comprising a side wall part, a top closure obturating part and a top sealing fin part, wherein:—

- the first and third obturating parts are substantially rectangular,
- the second and fourth obturating parts are each comprised of three substantially triangular sub-parts of which two have boundaries with extents substantially co-extensive with the extents of the respective first and third obturating parts and have other boundaries with extents substantially co-extensive with the third substantially triangular sub-part,

- those of said substantially triangular sub-panels having boundaries substantially co-extensive with the first obturating part having their said other boundaries upwardly and outwardly curved, and
- wherein the first obturating part has a through hole for receiving a pour spout fitment.

Owing to those aspects of the invention, it is possible both to define and support the curvature of the first wall.

According to a third aspect of the present invention, there is provided a container comprised of semi-rigid sheet material having a tubular main body and a gable-form part closing said body at one end thereof, said gable-form part comprising an outermost sealing fin, first and second diverging walls diverging inwardly from said fin relative to each other and whereof at least the first wall has complementarily curved inner and outer surfaces, first and second gable end walls each extending from the first to the second of said diverging walls and each having at least an upper part which is of substantially triangular outline as seen in end elevation, with an edge thereof at the inside surface of said first wall being curved and closely following the shape of that inside surface, the gable end walls further comprising a lower line of weakness extending substantially across the width of the gable end walls and forming a lower part of said gable-form part, wherein the lower line of weakness is downwardly bowed.

According to a fourth aspect of the present invention, there is provided a carton sleeve for a gable-form container comprising a loop of first, second, third and fourth substantially four-edged panels, each comprising a side wall part, a top closure obturating part and a top sealing fin part, wherein:—

- the first and third obturating parts are substantially rectangular,
- the second and fourth obturating parts are each comprised of three substantially triangular sub-parts of which two have boundaries with extents substantially co-extensive with the extents of the respective first and third obturating parts and have other boundaries with extents substantially co-extensive with the third substantially triangular sub-part, and
- those of said substantially triangular sub-parts having boundaries substantially co-extensive with the first obturating part having their said other boundaries curved, the second and fourth obturating parts further comprising a lower boundary line of weakness extending substantially thereacross, wherein the lower boundary line of weakness is downwardly curved.

According to a fifth aspect of the present invention, there is provided a container comprised of semi-rigid sheet material having a tubular main body and a gable-form part closing said body at one end thereof, said gable-form part comprising an outermost sealing fin, two diverging walls diverging inwardly from said fin relative to each other, wherein at least one of said two diverging walls, at said gable-form part, is curved in an axial plane of said container, and two gable end walls each extending from one to the other of said diverging walls and each having at least an upper part which, as seen in end elevation, is of a substantially triangular outline and comprises a plurality of panels distributed thereacross from one to the other of said two diverging walls.

According to a sixth aspect of the present invention, there is provided a carton sleeve comprising a loop of first, second, third and fourth substantially four-edged panels, each comprising a side wall part, a top closure obturating part and a top sealing part, wherein:— the first and third obturating parts are substantially rectangular, the second and fourth obturating parts are each comprised of three substantially triangular sub-parts of which two have boundaries with extents substantially co-extensive with the extents of the respective first and third obturating parts and have other boundaries with extents substantially co-extensive with the third substantially triangular sub-part, said other boundaries being curved, and each third substantially triangular sub-part comprises a plurality of panels distributed thereacross from one to the other of the two adjacent substantially triangular sub-parts.

According to a seventh aspect of the present invention, there is provided a container comprised of semi-rigid sheet material and having a tubular main body and a gable-form part closing said body at one end thereof, said gable-form part comprising an outermost sealing fin, first and second diverging walls diverging inwardly from said fin relative to each other, said first wall, at said gable-form part, being outwardly curved in an axial plane of said container, and gable end walls each extending from one to the other of said diverging walls and each comprised of a rounded formation substantially matched to the curvature of said first wall at said gable-form part and tending to support that curvature against change.

According to an eighth aspect of the present invention, there is provided a carton sleeve comprising a loop of first, second, third and fourth substantially four-edged panels, each comprising a side wall part, a top closure obturating part and a top sealing fin part, wherein:— the first and third obturating parts are substantially rectangular, the second and fourth obturating parts are each comprised of three substantially triangular sub-parts of which two have boundaries with extents substantially co-extensive with the extents of the respective first and third obturating parts and have other boundaries with extents substantially co-extensive with the third substantially triangular sub-part, and said three substantially triangular sub-parts having a rounded outline.

According to a ninth aspect of the present invention, there is provided a container comprised of semi-rigid sheet material and having a tubular main body and a gable-form part closing said body at one end thereof, said gable-form part comprising an outermost sealing fin, first and second diverging walls diverging inwardly from said fin relative to each other, the diverging walls, at said gable form part, being curved in an axial plane of said container, and gable end walls extending from one to the other of the diverging walls and formed with respective arrays of radiating fold lines bounding respective arrays of wall parts serving to define and support the curvatures of the diverging walls.

According to a tenth aspect of the present invention, there is provided a carton sleeve comprising a loop of first, second, third and fourth substantially four-edged panels, each comprising a side wall part, a top closure obturating part and a top sealing fin part, wherein:— the first and third obturating parts are substantially rectangular, and the second and fourth obturating parts are each comprised of radiating arrays of lines of weakness extending towards the first and third obturating parts.

Owing to those two aspects of the invention, the curvatures of the diverging walls can be well defined and supported.

Irrespective of whether or not the gable end walls have such radiating arrays, it is advantageous for them to be of rounded outlines, for example heart-shaped, or, particularly, oval, since such outlines give good strength.

According to an eleventh aspect of the present invention, there is provided a carton blank for forming a gable top carton, and comprising a row of first, second, third and fourth substantially four-edged panels, each including a top sealing fin part, wherein the first four-edged panel has a through hole for receiving a pour spout fitment, and each extending from a bottom edge of the blank to an outermost boundary of the top sealing fin part, at least the upper half of each of the first and third panels being substantially free from any line of weakness extending inwardly from lateral edge zones of that panel.

According to a twelfth aspect of the present invention, there is provided a gable top carton comprising a loop of first, second, third and fourth substantially four-edged panels, each including a top sealing fin part and extending over the height of the carton, the first four-edged panel having a pour spout fitment attached thereto, at least the upper half of each of the first and third panels being substantially free from any line of weakness extending inwardly from lateral edge zones of that panel.

Owing to those two aspects of the invention, artwork can occupy the outer surfaces of at least the upper halves of the first and third panels without any interruption by transverse score lines.

According to a thirteenth aspect of the present invention, there is provided a A gable-top carton having a top closure sealing fin, and a first top closure obturating part having a pour spout fitment attached thereto, said fin being folded back and attached substantially face-to-face to a second top closure obturating part at the opposite side of the root of said fin from said first top closure obturating part.

Owing to that aspect of the invention, the holding of a gable top carton by insertion of the thumb and one or more fingers of one hand at respective opposite gable ends can be facilitated because the top sealing fin does not form an obstruction.

That aspect of the invention is particularly advantageous if there is at the first obturating part a device permitting access to and drinking of flowable content of the carton, since the top sealing fin is not in the way of the consumer's nose.

In the event that the device is a pour spout fitment which tends to strengthen the first top closure obturating part, that part is advantageously weakened by score lines at at least its gable end edges to facilitate bending under the action of the carrier's grip. For the same purpose, such score lines may also be provided in the second top closure obturating part at at least its gable end edges.

According to a fourteenth aspect of the present invention, there is provided a method comprising sealing together face-to-face portions of sheet material so as to form a sealing fin of a container provided at least partly by said sheet material and so that said sealing fin has a liquid-tight sealing zone over the length of said fin, and cutting away one or more parts of said fin outwards of an inner edge region of said zone, so as to give said fin a desired profile.

The container may be a gable-top container and the sealing fin a top sealing fin thereof.

If desired, the cutting away may be performed so as to change the external profile of the sealing fin.

According to a fifteenth aspect of the present invention, there is provided apparatus comprising a sealing device arranged to seal together face-to-face portions of sheet material so as to form a sealing fin of a container provided at least partly by said sheet material, and a cutting device arranged to cut away one or more parts of said fin outwards of an inner edge region of said zone, so as to give said fin a desired profile.

That apparatus may be included in a form-fill-seal packaging machine, which may be a packaging-blanks-fed machine.

In order that the invention may be clearly and completely disclosed, reference will now be made, by way of example, to the accompanying drawings, in which:—

Figure 1:
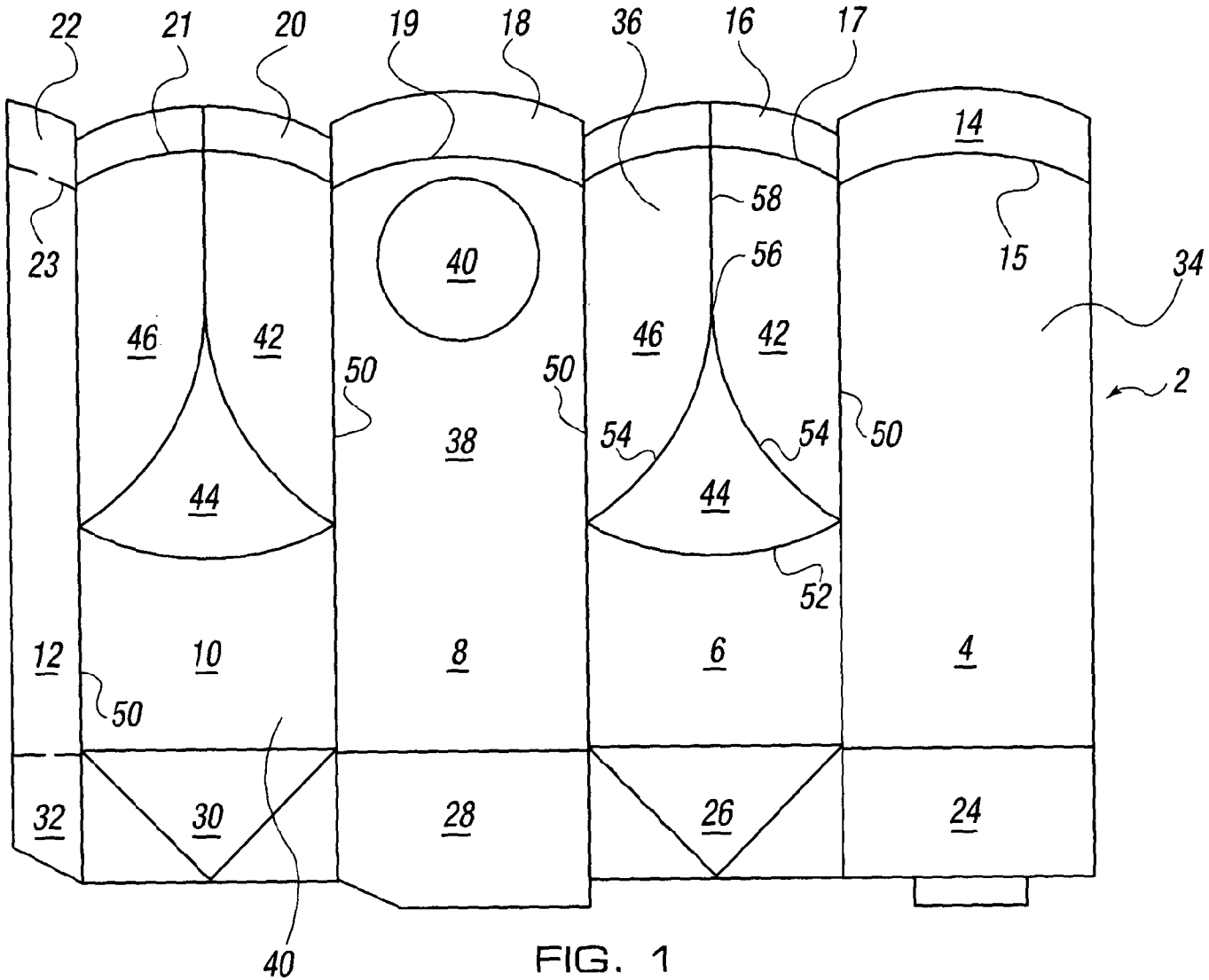
FIGS. 1 to 26 are plan views of respective flat carton blanks of twenty-six embodiments of the present invention.

Referring to FIG. 1, there is seen a blank 2 consisting of first, second, third, fourth and fifth panels 4, 6, 8, 10 and 12, respectively. The panels 4 to 12 include respective top sealing sub-panels 14, 16, 18, 20 and 22, of an outwardly bowed form bounded inwardly by respective score lines 15, 17, 19, 21 and 23. The panels 4 to 12 also include respective bottom sealing sub-panels 24, 26, 28, 32 and 34 of a per se known form. The panels 4 and 8 also include respective intermediate panels 34 and 38 which are each uninterrupted by score lines, except that the intermediate sub-panel 38 is formed with a through hole 40 for receiving a pour spout fitment (not shown). The panels 6 and 10 include respective intermediate sub-panels 36 and 40 which are divided by score lines into respective sub-sub-panels 42 and 44, identically as between the sub-panel 36 and the sub-panel 40. The panels 4 to 12 are defined by respective rectilinear score lines 50 extending transversely to the row of panels 4 to 12, the score lines defining the sub-sub-panels 42 and 44 consisting of a downwardly bowed score line 52 extending along the row of panels 4 to 12 and a pair of downwardly and inwardly bowed score lines 54 extending to the respective ends of the score line 52 and joining each other at an apex 56 half-way between the adjacent score lines 50 and spaced below the sealing sub-panel 16 or 20, as the case may be. From that apex 56 there extends to the outer edge of the sealing sub-panel 16 or 20, as the case may be, a central, rectilinear score line 58.

Figure 2:
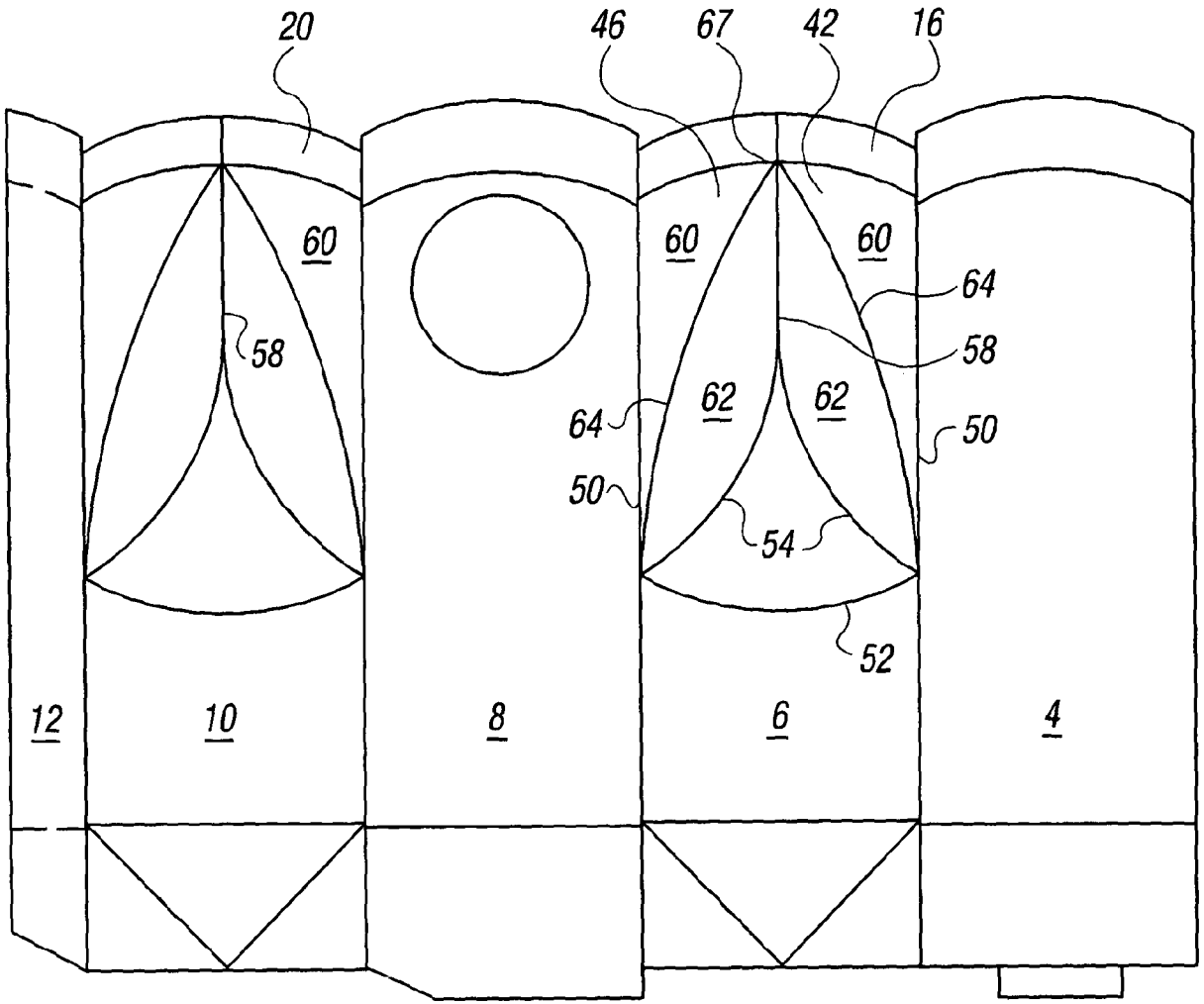

The blank shown in FIG. 2 differs from that shown in FIG. 1 solely in that the sub-sub-panels 42 and 46 are themselves divided into respective sub-sub-sub-panels 60 and 62 by respective upwardly and outwardly bowed score lines 64 and 66 which extend from the respective ends of the score line 52 to the intersection 67 between the score line 58 and the score line 17. Following production of a bottom-sealed carton from this blank and filling and top-sealing of the carton, the curved edges arising as a result of the presence of the score lines 64 tend to determine the depth and curvature of the front and rear roof parts of the carton. Furthermore, the lanceolate sub-sub-sub-panels 62 give support for those curved edges. It should be mentioned that the natural folding of the gable end is outwards rather than inwards as desired and the lanceolate sub-sub-sub-panels 62 promote inward folding of the gable end. It will be understood that, since the roof parts of the panels 4 and 8 are deeper than in a more traditional gable top carton, such as that disclosed in WO2010/070121A1, those parts need more support than in the traditional carton.

Figure 3:
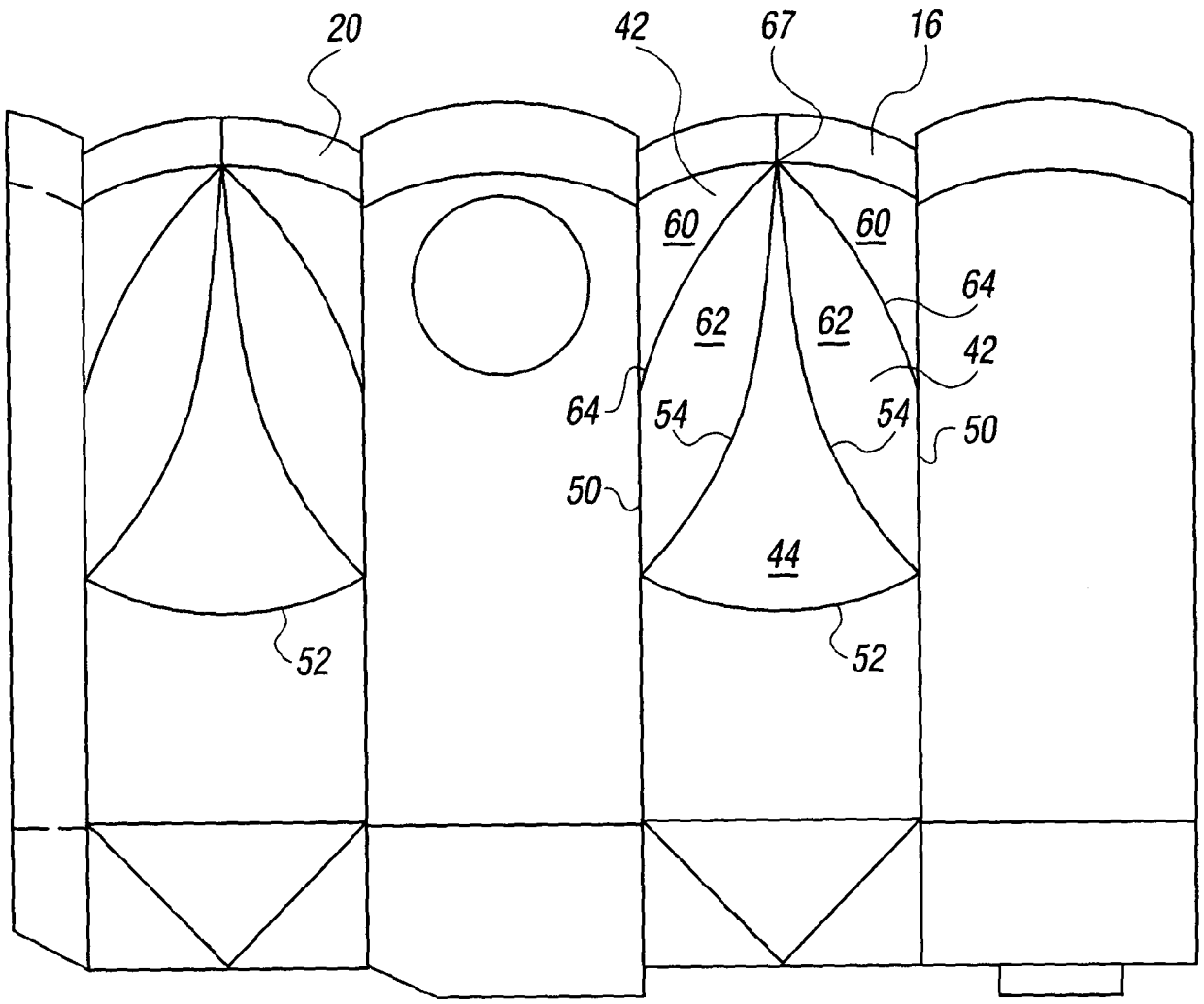

The blank shown in FIG. 3 differs in two respects from that shown in FIG. 2. Firstly, the score lines 64 and 66, although extending from the intersection 67 to the adjacent score lines 50, meet the score lines 50 at locations spaced away from the score line 52 in the direction of the sealing sub-panel 16 or 20, as the case may be. The other difference is that the triangular sub-sub-sub panel 44 has its apex 56 coincident with the intersection 67; in other words, the score line 58 is dispensed with. This blank takes into account the possible concern with a relatively tall carton with the score line 52 relatively far down the carton that it is not advisable for two score lines very gradually to approach and contact each other in an almost parallel manner, since scoring tools on a machine for converting webs of board into flat blanks and then into flat sleeves for supply to the packager tend to damage the board in those circumstances. The design of the gable end in FIG. 3 thus avoids having relatively long and narrow gaps, the board (such as paperboard substrate with innermost and outermost layers of a moisture-barrier plastics, possibly with the interposition of an oxygen barrier layer) being left to find its own natural bends between, say, the score lines 64 and the adjacent score lines 50. Compared with the blank of FIG. 2, that of FIG. 3 also takes into account that the greater the number of score lines meeting at one point, the greater the risk of damage to the board at that point during forming of the score lines and subsequent folding thereof.

Figure 4:
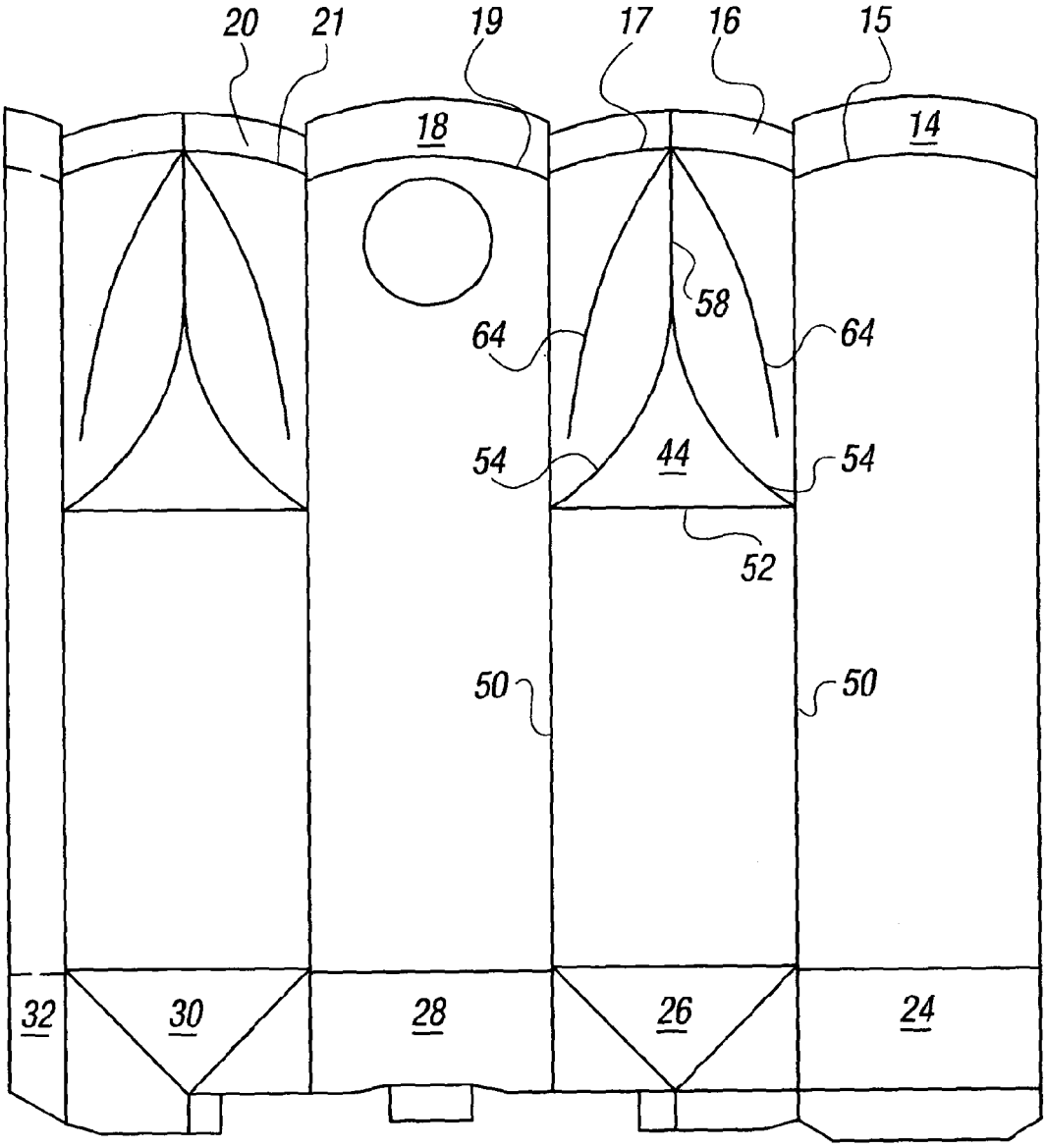

The blank shown in FIG. 4 differs from that shown in FIG. 2 in a number of respects. Firstly, the score lines 64 and 66 extending from the intersection 67 do not meet the respective score lines 50 but are spaced therefrom. Moreover, they are also spaced from the score lines 52 and 54. Furthermore, the score line 52 is rectilinear as opposed to being downwardly bowed towards the bottom closure panels 24 to 32. The feature that the lower ends of the score lines 64 are slightly spaced from the adjacent score lines 50 and from the score line 52 is for a similar purpose to that in the embodiment of FIG. 3, the board again tending to find its own natural bends between the lower ends of the score lines 64 and the adjacent score lines 50 and the triangular sub-sub-panel 44 bounded by the score lines 52 and 54. In further embodiments which are not shown, the score line 52 can be omitted completely or centrally broken.

Figure 5:
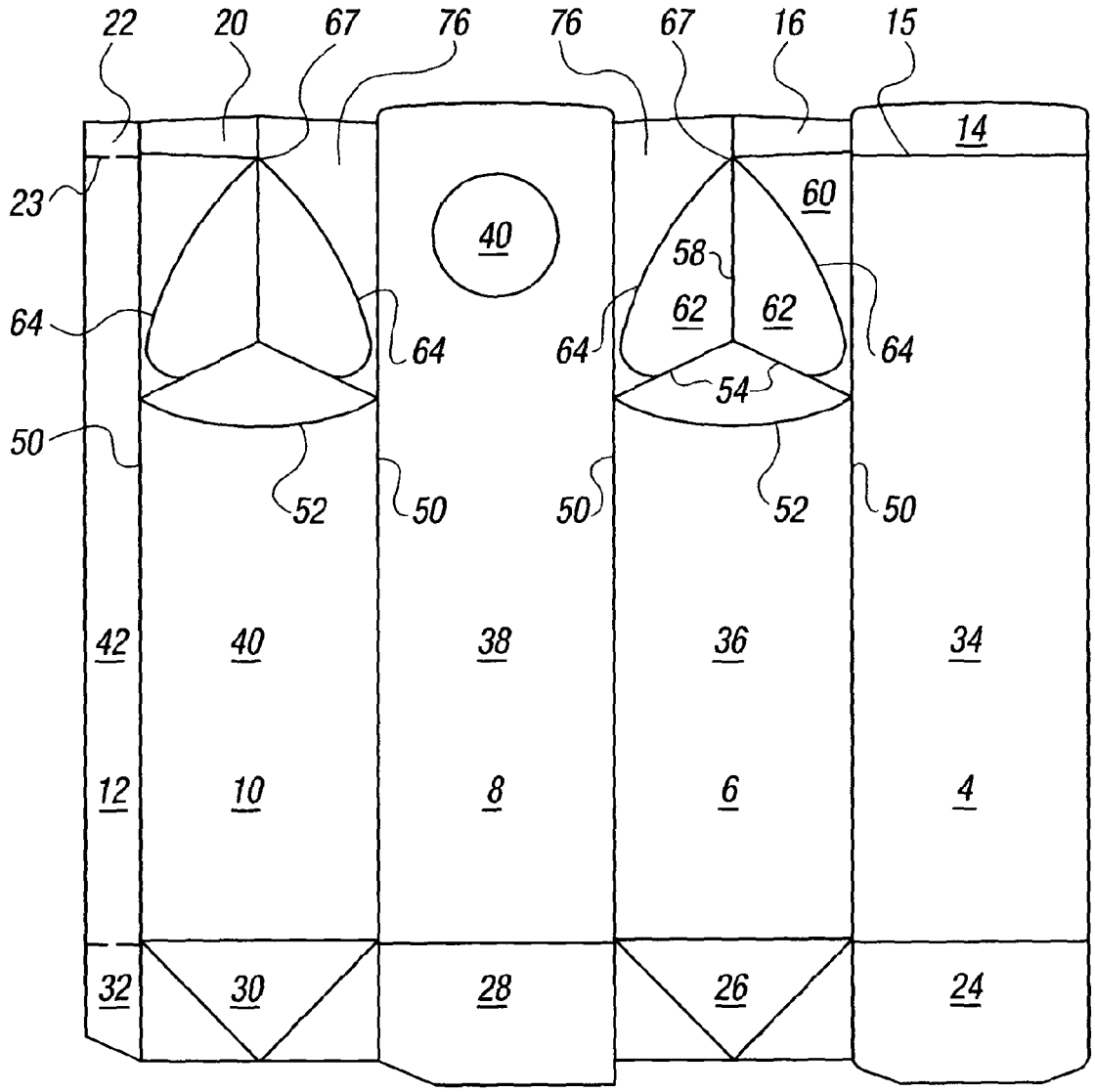

There are significant differences between the carton blank shown in, say, FIG. 2, and that shown in FIG. 5. Each curved score line 52 is again downwardly bowed, but is significantly nearer to the sealing-sub-panel 16 or 20. Each score line 54 is rectilinear rather than curved. Each score line 64 does not contact its adjacent score line 50, and moreover is inwardly curved to meet the adjacent score line 54 gently between the ends of the latter. Furthermore, the sub-sub-sub panel 60 nearer the sub-panel 38 and that half of the sealing sub-panel 16 or 20, as the case may be, nearer that sub-panel 38 are combined to form a combined panel 76 so, with the score line 19 omitted, promoting having the sealing fin 70 co-planar with the front roof part.

The embodiment shown in FIG. 5 differs from that shown in, say, FIG. 2 in that the triskelion formed by the score lines 54 and 58 has rectilinear limbs, whilst the score line 52 is bowed towards the row of bottom closure sub-panels 24 to 32. Furthermore, the score lines 64 do not contact the respective score lines 50; they do contact the respective score lines 54, but by gently merging into them at intermediate locations on the score lines 54.

Figure 6:
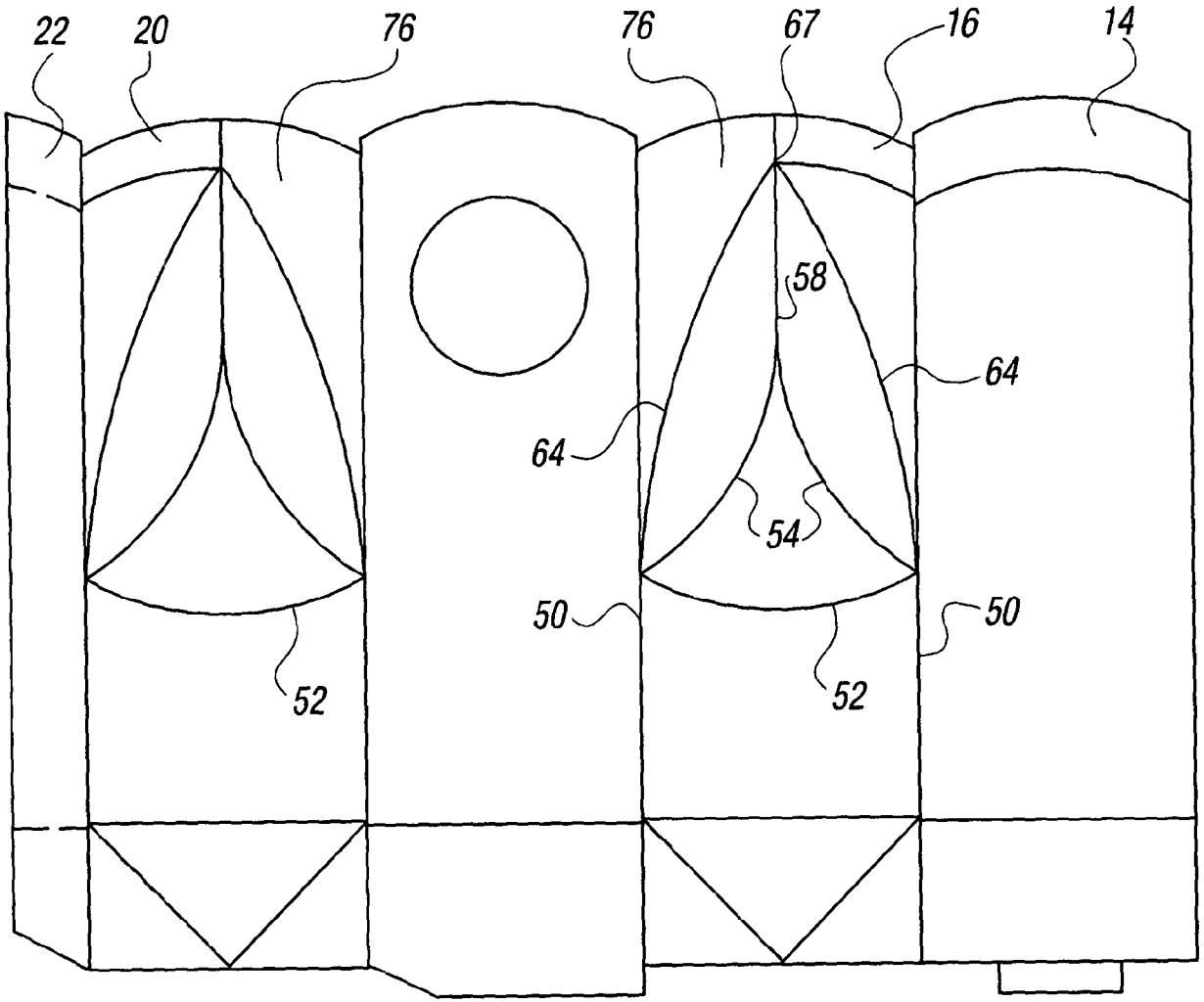

The blank of FIG. 6 differs from that of FIG. 2 in two respects. Firstly, the score lines 52 and 64 do not meet the adjacent score line 50, although they still meet each other. Secondly, a combined panel 76 is provided. It will be appreciated that this gable top closure is shorter in relative proportion. If so desired, the score lines 15 and 23 may be omitted, as well as the score line 19, so as to enable artwork to be printed on the external surfaces of the panels 4 and 8 on their areas above the bottom closure sub-panels 24 to 32 without interruption by transverse score lines.

Figure 7:
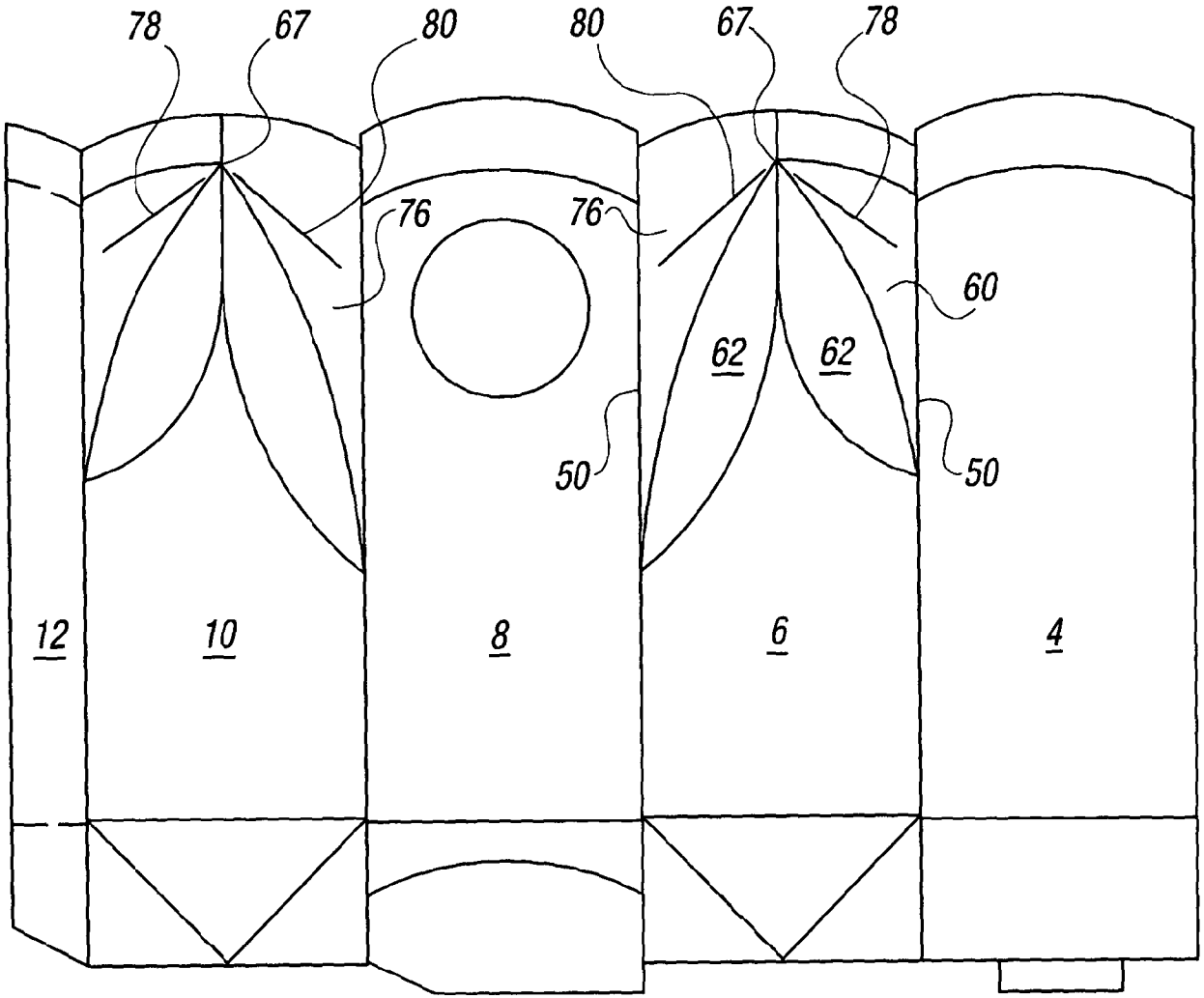

The blank shown in FIG. 7 is very significantly different from that shown in FIG. 2. In particular, each score line 52 has been omitted; furthermore, the sub-sub-sub-panels 62 are asymmetrical about the centre line of the panel 6 or 10. In addition, from each intersection 67 there also extend two score lines 78 and 80 of which the score line 78 extends into the sub-sub-sub panel 60 obliquely to the row of panels 4 to 12 but stops short of the adjacent score line 50, whilst the other score line 80 extends into the combined panel 76 obliquely to the row of panels 4 to 12 but stops short of the adjacent score line 50. The score line 80 is more steeply inclined relative to the score lines 50 than is the score line 78. The carton produced from the blank of FIG. 7 is asymmetrical. Moreover, the omission of the score line 52 allows the board to make a smoother transition between the vertical part of the panel 6 or 10 and the gable end.

Figure 8:
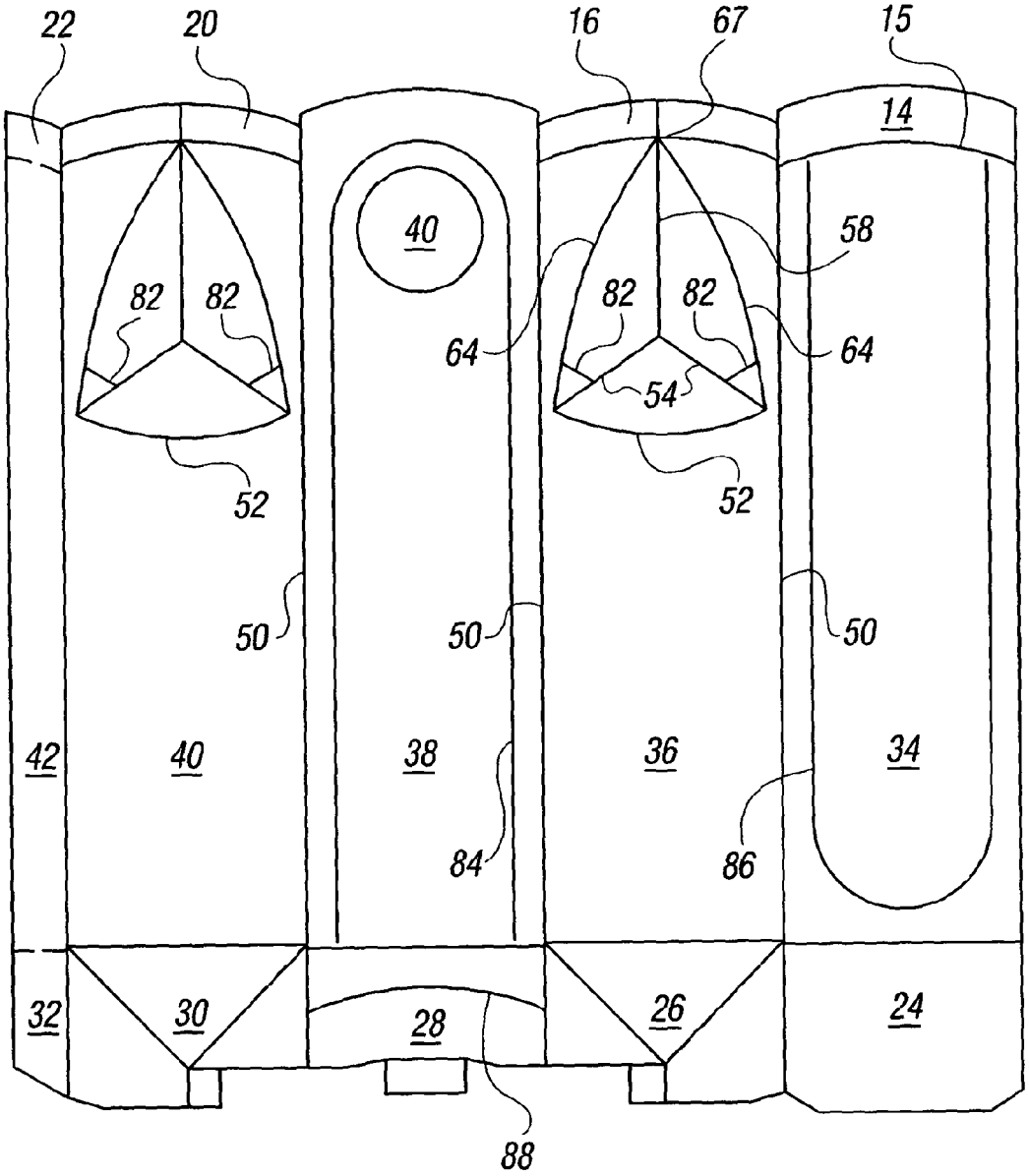

The embodiment shown in FIG. 8 differs from that shown in, say, FIG. 5 in a number of respects. Firstly, the score line 52 extends to short of the adjacent score lines 50. Secondly, the score lines 64 extend from the intersection 67 to the respective ends of the score line 52, whilst, adjacent to those ends, there are short, rectilinear score lines 82 between the score lines 54 and the respective, adjacent score lines 64. Thirdly, the sub-panels 34 and 38 are formed with U-shaped score lines 86 and 84 mainly for aesthetic reasons. This blank has the advantages that the triskelion provided by the three score lines 54 and 58 facilitates pushing-in the gable end in top-closing the carton and that the three sub-panels defined among the legs of the triskelion provide very strong support for the curved folds produced by the score lines 64. The short score lines 82 remove a tendency of the corners between the score lines 54 and 64 to fold in an unpredictable manner.

Figure 9:
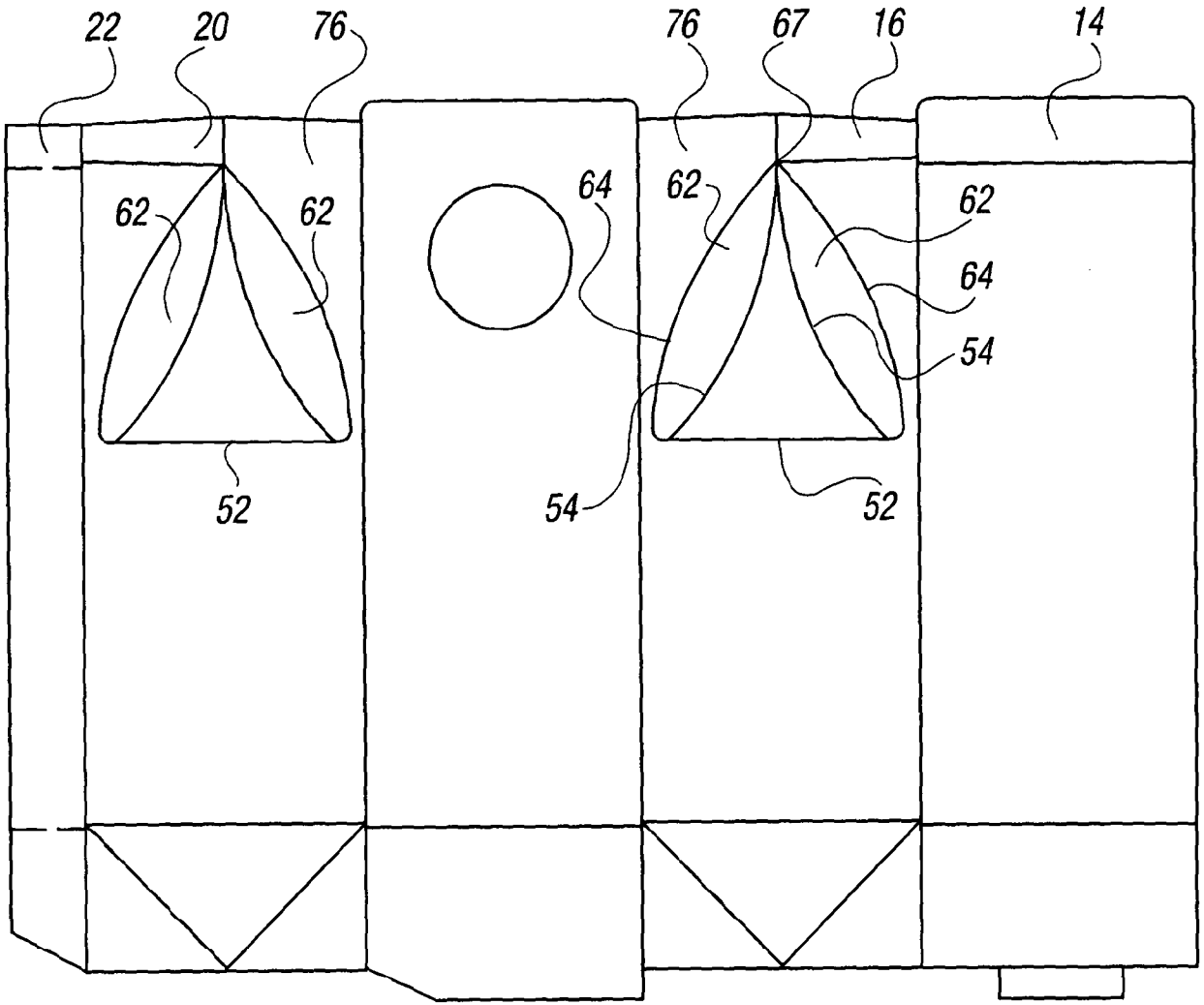

The embodiment shown in FIG. 9 differs from that shown in FIG. 6 in a number of respects. Firstly, the score line 52 is rectilinear. Moreover, the sealing sub-panels 14, 16, 20 and 22 are straight rather than curved. Furthermore, the meeting point of the score lines 54 is just short of the intersection 67. Another difference is that, instead of each score line 54 and its adjacent score line 64 meeting at a sharp point at the score line 52, they merge into each other in a rounded manner. The feature whereby the score lines 54 stop short of the junction 67 has the advantage of allowing the board to find its own bend between those items. Similarly, the feature that the lower ends of the sub-sub-sub-panels 62 are curved and not sharp and that they merge relatively gently into the score line 52 enables the board there to bend more naturally than if there were sharp meeting points.

Figure 10:
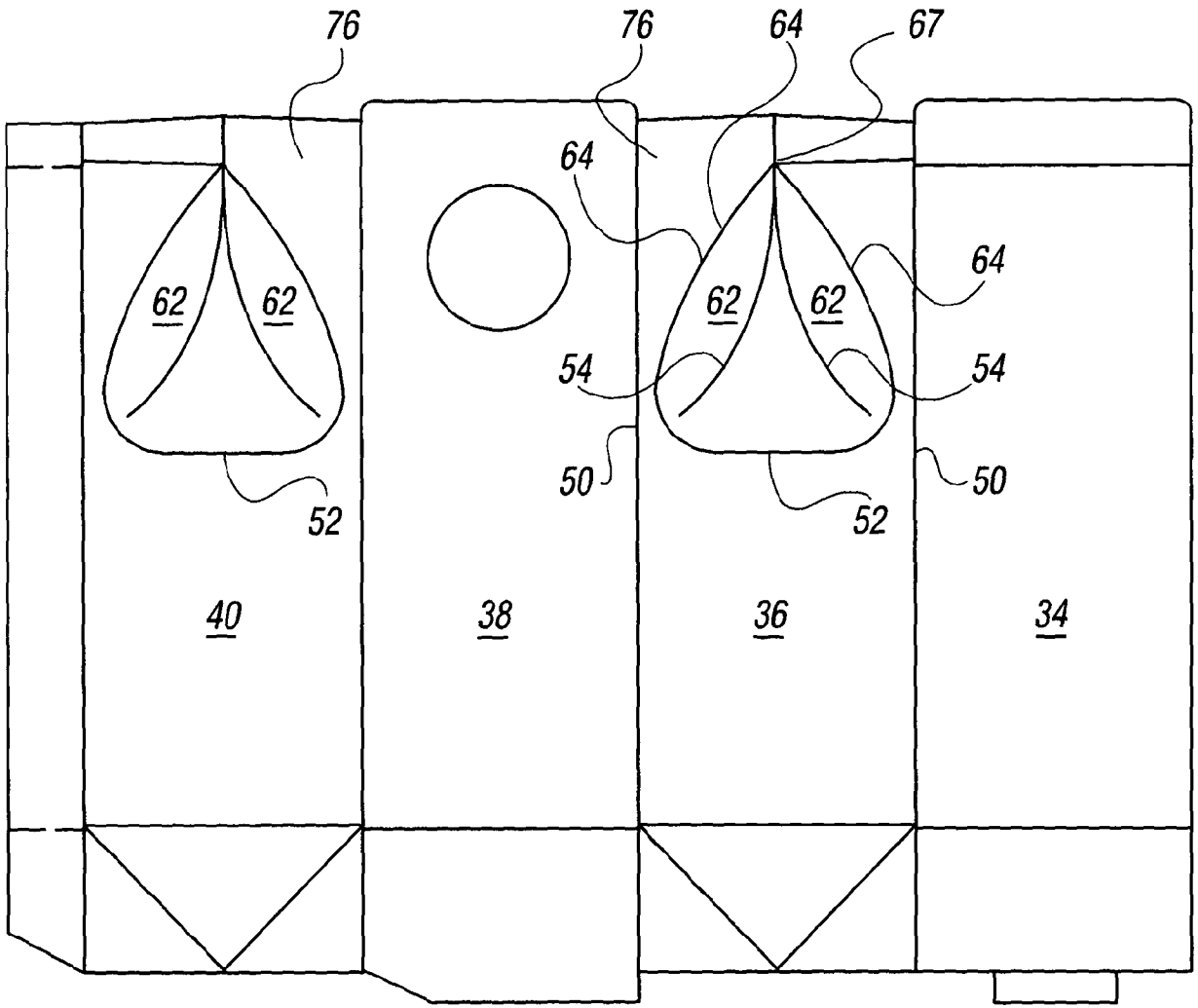

Referring to FIG. 10, the embodiment shown therein is similar to that shown in FIG. 9, except that the score lines 54 merge and continue to the intersection 67, whilst the rectilinear score line 52 merges in a rounded manner with the score lines 64. Furthermore, those ends of the score lines 54 further from the intersection 67 terminate short of the score lines 52 and 64. It will be noted that the heart-shape formed by the score lines 52 and 64 is again spaced from the score lines 50 for the same reason as why the score lines 64 were themselves spaced from the adjacent score lines 50. The score lines 54 are not essential but are preferred, since, with them present, a simple inward push in the area of the junction 67 bends the parts of the gable end into the right shape.

Figure 11:
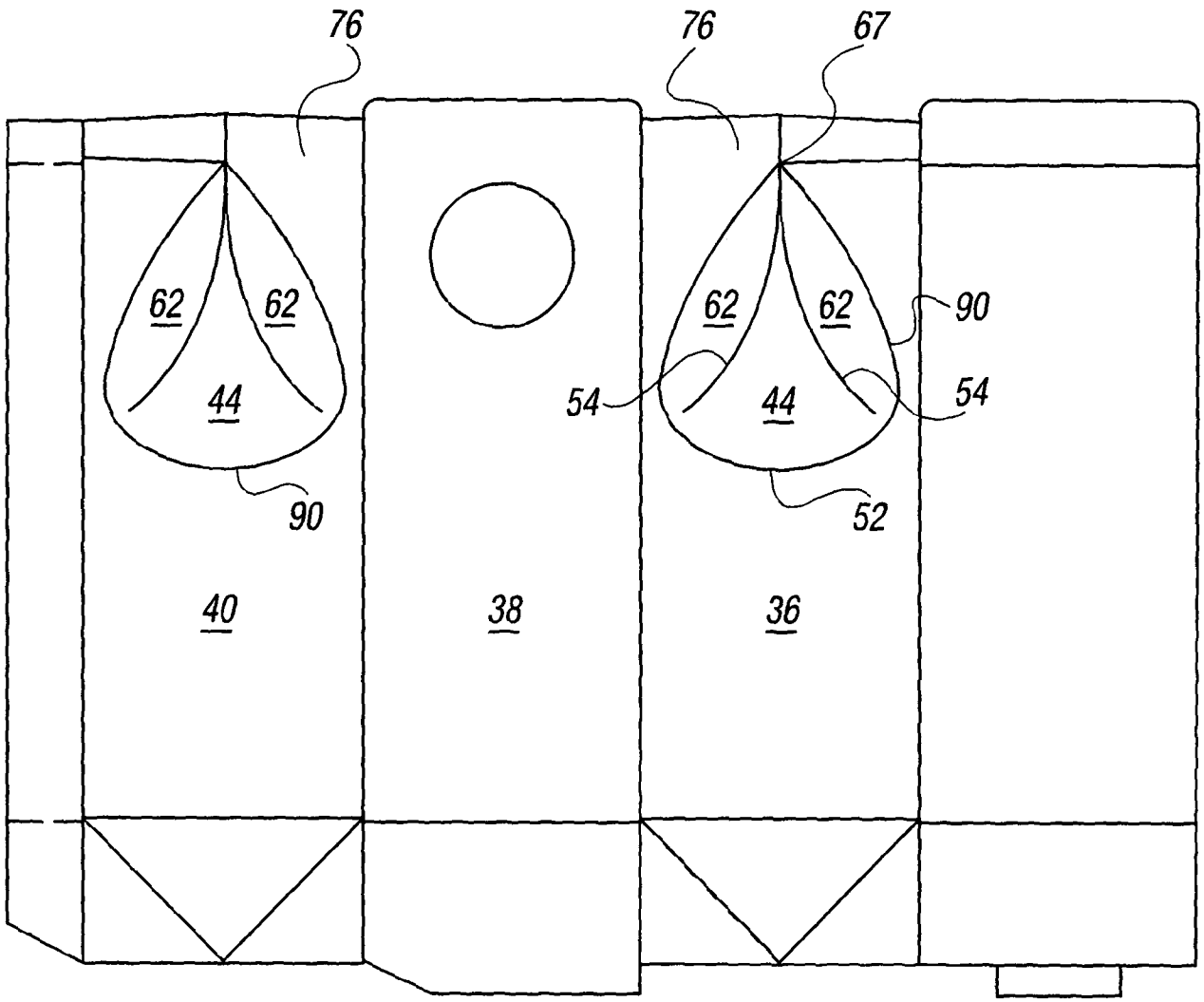

Similar comments apply in respect of the embodiment of FIG. 11, except that, in addition, making the score line 52 downwardly bowed instead of rectilinear gives a slightly more heart shape 90 than in FIG. 10 and thus slightly stronger.

Figure 12:
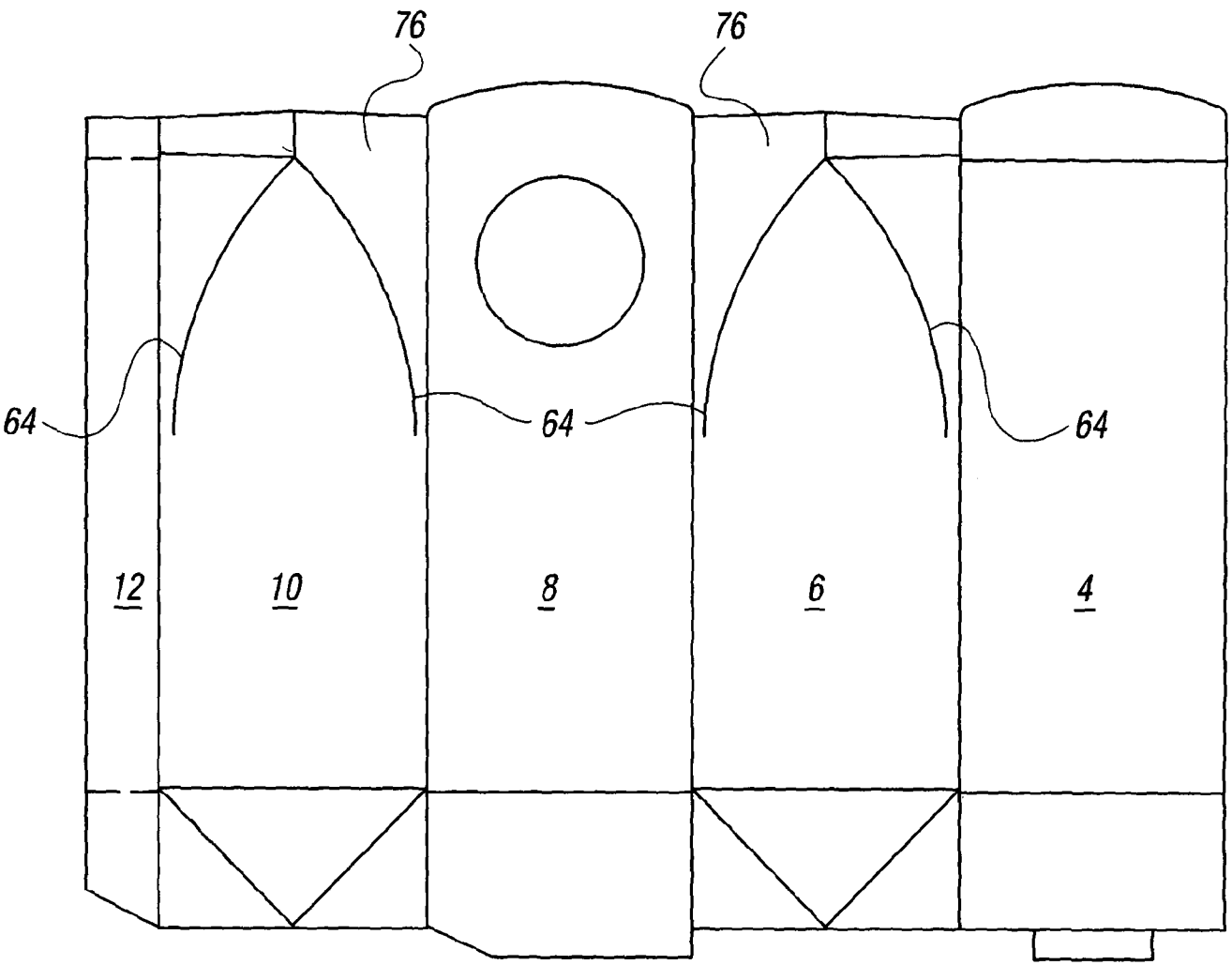

The embodiment shown in FIG. 12 differs significantly from that shown in, say, FIG. 10, in that the score lines 52 and 54 are omitted completely. This embodiment is practically the simplest insofar as the score lines defining the gable end are concerned, with solely the score lines 64, so that the board upwards of the vertical parts of the panels 6 and 10 tends to find its own curved shape, except where restrained by the score lines 64.

Figure 13:
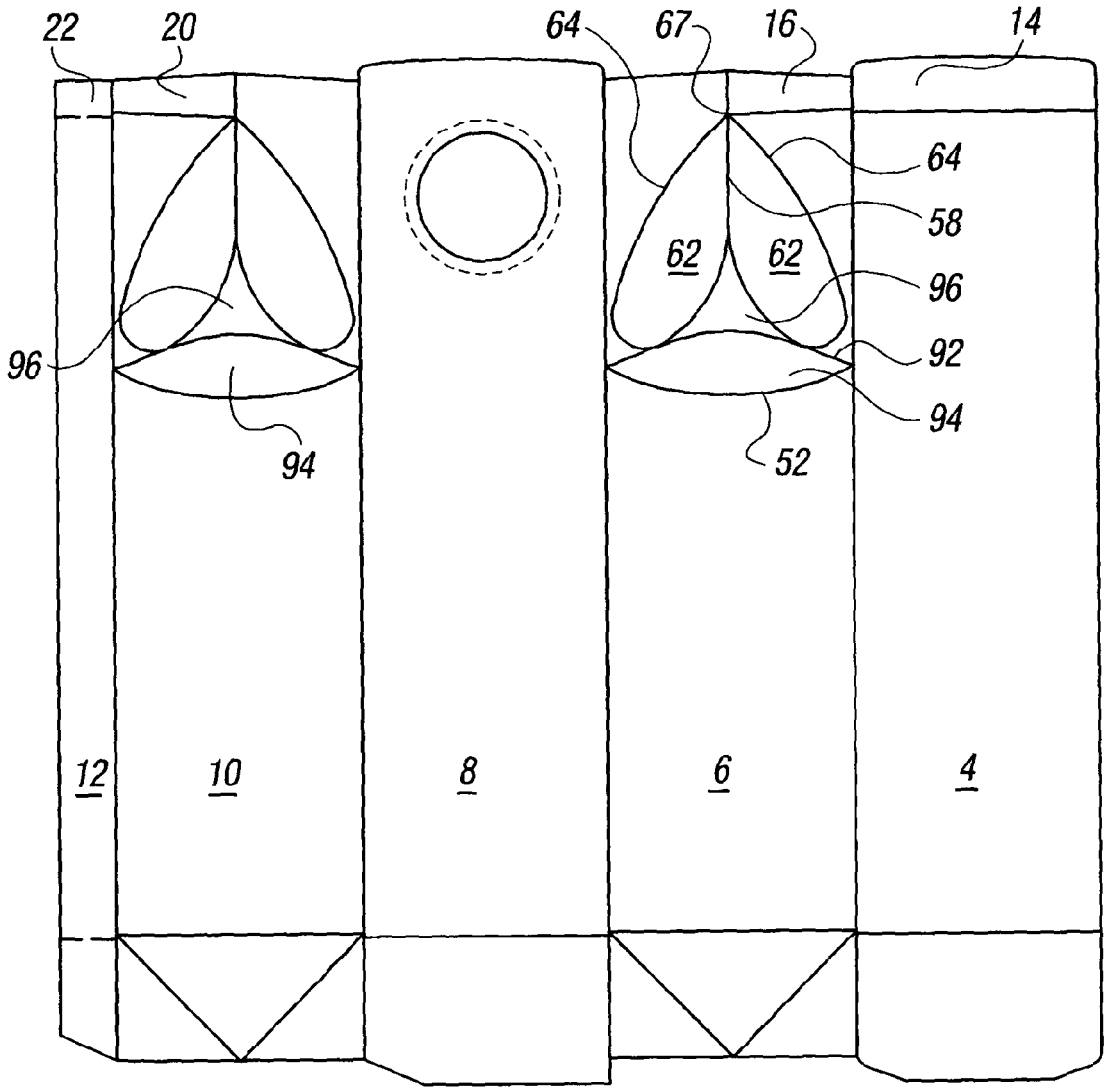

The embodiment shown in FIG. 13 differs from that shown in, say, FIG. 5, in that the rectilinear score lines 54 can be considered to be replaced by an outwardly bowed score line 92 the ends of which are at the ends of the outwardly bowed score line 52 so as to give a lenticular sub-sub-sub-panel 94 outwardly of which in the direction of the sealing fin 16 is a triangular sub-sub-sub-panel 96 located among the sub-sub-sub-panels 62 which are themselves defined by causing the score lines 64 to curve back upon themselves to merge in a rectilinear score line 58. The score lines 64 touch the score line 92 at locations spaced inwardly from the ends of the score line 92. The embodiment shown in FIG. 13 has the feature that there are a significant number of curved score lines within the area bound by the score lines 52 and 64, so that the folding of the gable end is more guided, whilst the sub-sub-sub-panel 94 gives a predetermined stepped transition from the vertical part of the panel 6 or 10 before the triangular sub-panel 96 is reached.

Figure 14:
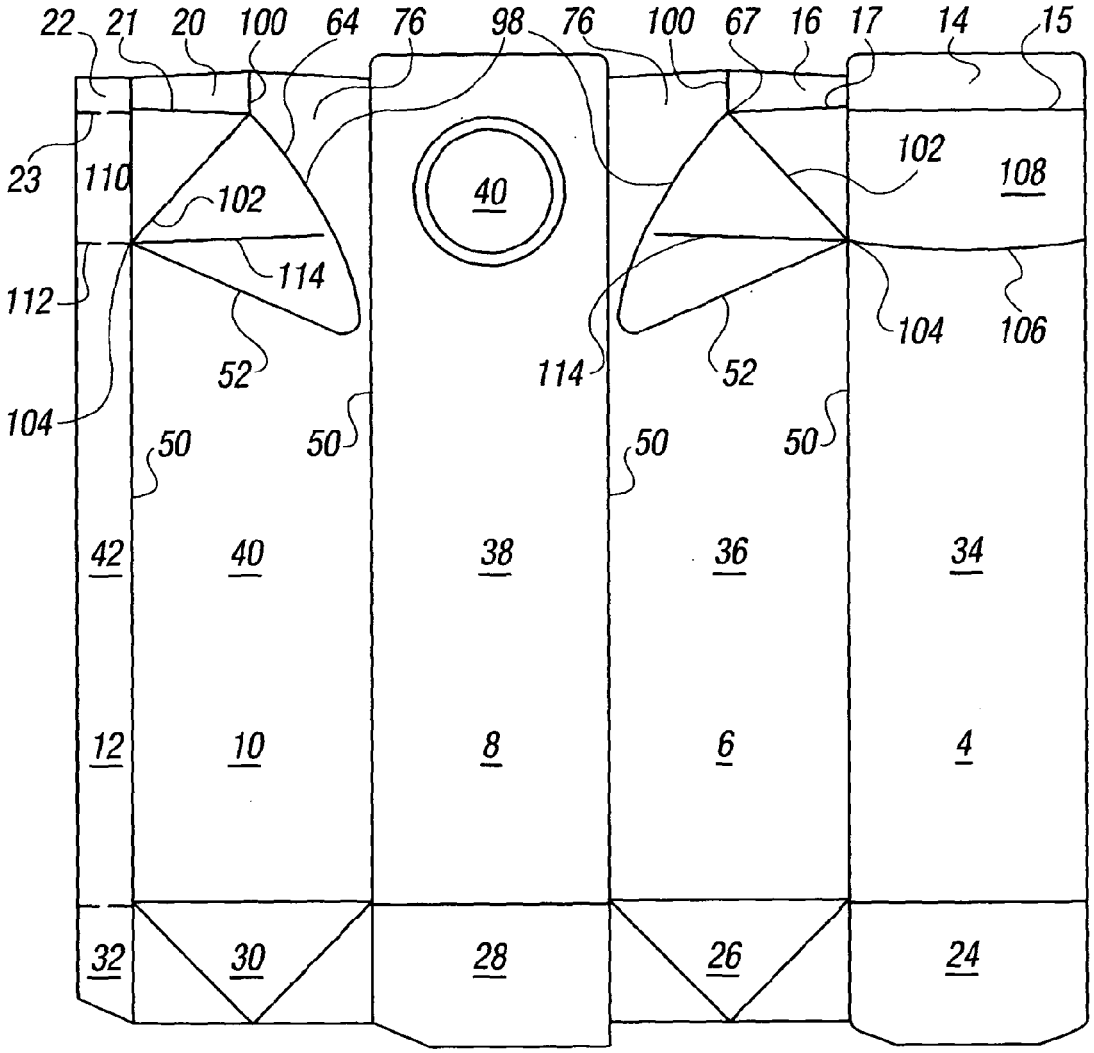

In the embodiment shown in FIG. 14, the score line 52 is inclined obliquely towards the bottom closure sub-panels 24 to 32 and towards the sub-panel 38. It stops short of the score line 50 bounding its side of the body sub-panel 38 and there merges in a rounded manner into a score line 98 which is bowed away from the bottom closure sub-panels 24 to 32 and towards the hole 40. The opposite end of the score line 98 terminates at a junction 67 among the score line 17, a short score line 100 at that edge of the sealing sub-panel 16 or 20 nearer the body sub-panel 38, and a rectilinear score line 102 which extends to a junction 104 among the score line 50 between the panels 4 and 6, the score line 52, and a score line 106 extending the whole width of the panel 4 and slightly bowed towards the row of bottom closure sub-panels and thereby forming an obturating sub-panel 106 between the sub-panels 14 and 34. The score line 102 is obliquely inclined to the row of panels 4 to 12. In the panel 12 an obturating sub-panel 110 is provided by a score line 112 parallel to the row of panels 4 to 12. From the junction 104, there extends part-way across the panel 6 or 10 a score line 114 which is substantially an extension of the score line 106 or 112. The score line 114 is rectilinear, slightly inclined towards the hole 40 from the junction 104, and terminates short of the score line 98. The carton formed from the blank is asymmetrical. The score lines 114 are not essential but they assist in transition from the fold arising owing to the score line 52 to the folds arising owing to the score lines 102 and 98. The termination of the score lines 114 short of the score lines 98 enables the board to find its own natural bend at those locations.

Figure 15:
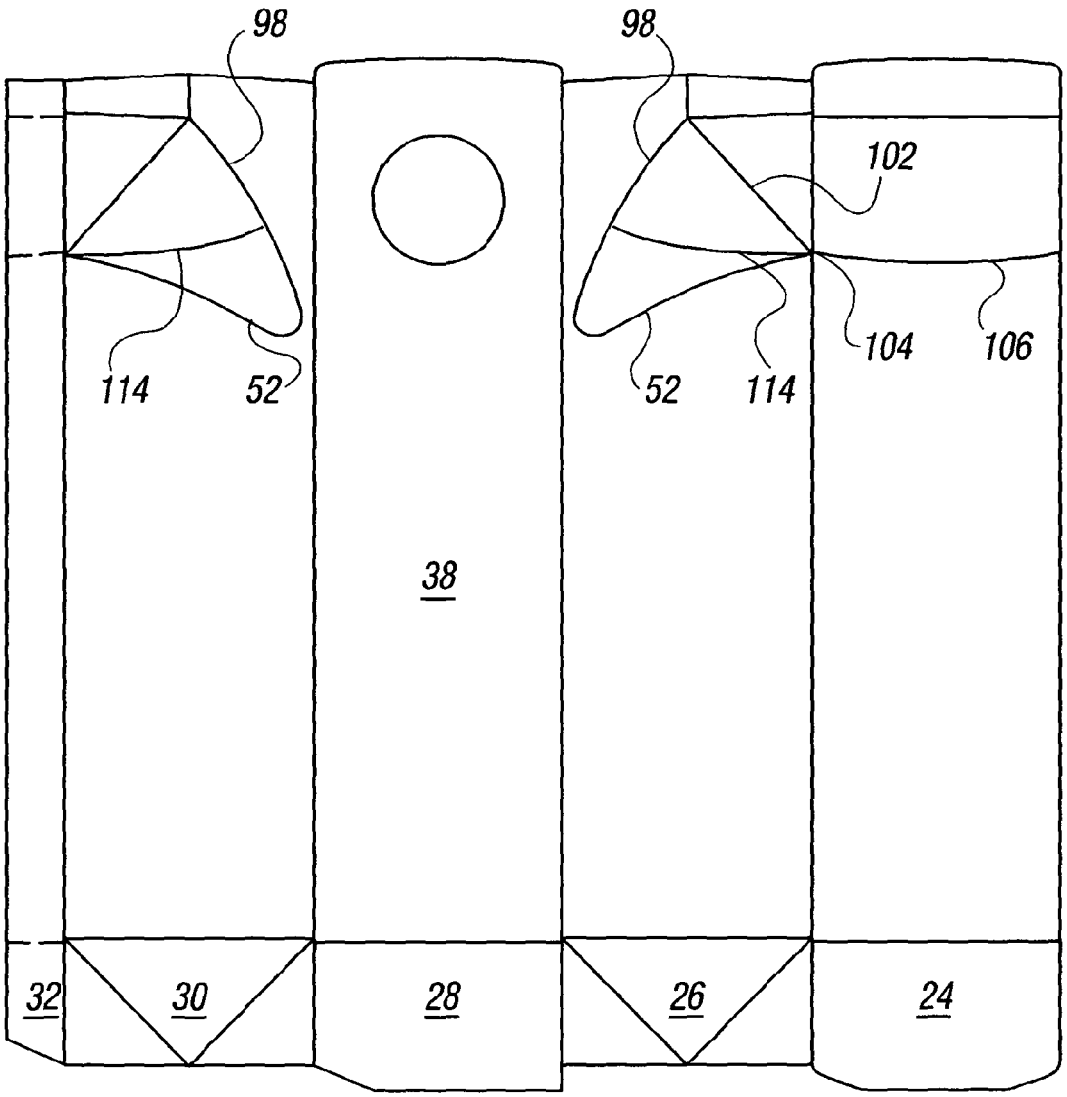

The blank shown in FIG. 15 differs from that shown in FIG. 14 in two respects. Firstly, the score line 52 is slightly bowed away from the row of bottom closure sub-panels. Secondly, the score line 114 is slightly bowed towards the row of bottom closure sub-panels and meets the score line 98.

Figure 16:
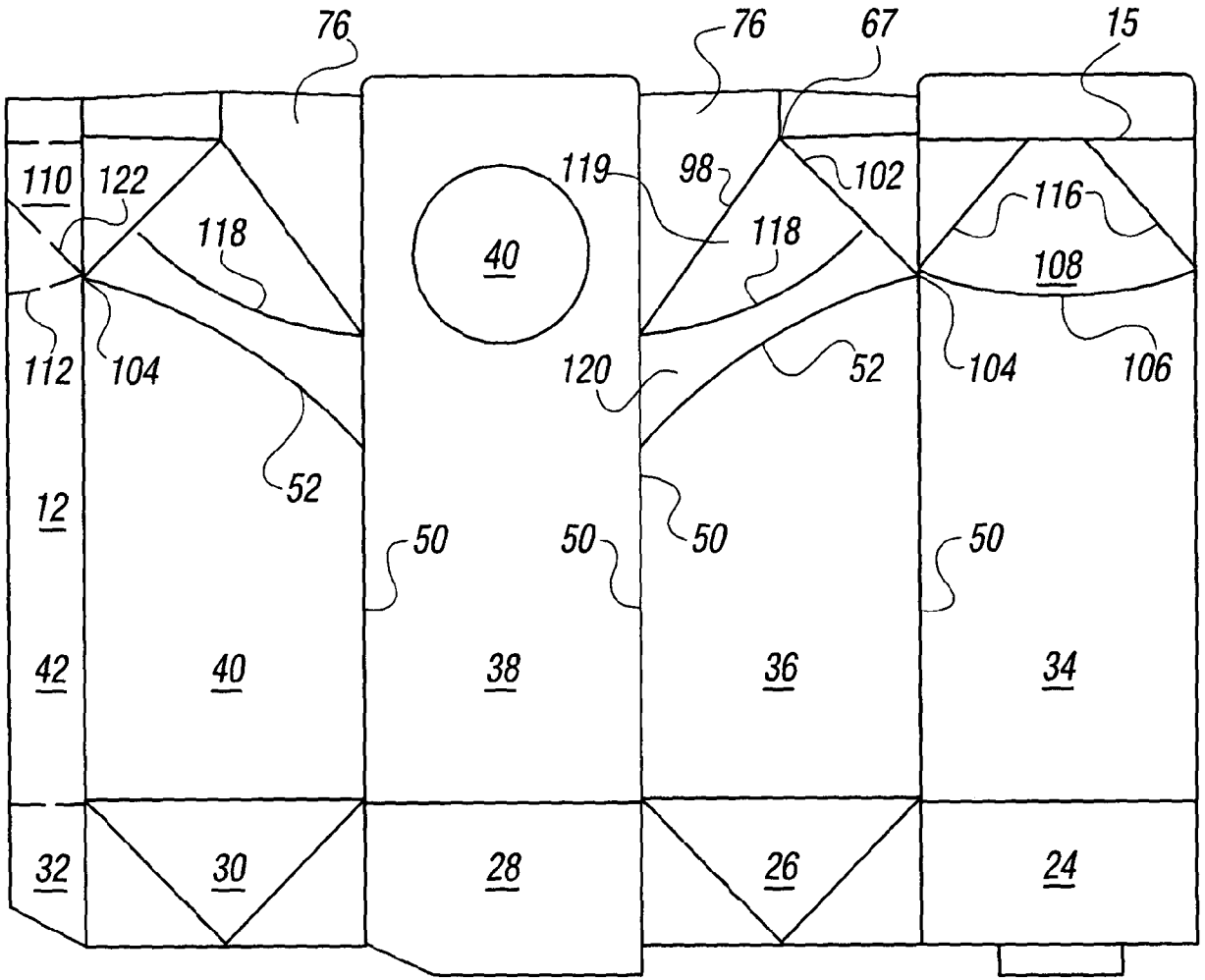

The embodiment shown in FIG. 16 has some similarities with that shown in, say, FIG. 14, but, inter alia, avoids having, in the filled and sealed carton, a step in the score lines 98, as results from the presence of the score line 114. There are again an inwardly bowed score line 106, but the obturating sub-panel 108 is formed with two rectilinear score lines 116 extending from the ends of the score line 106 and symmetrically convergingly towards each other to meet the score line 15 at locations spaced apart from each other. Yet again, the score line 102 extends between the junctions 67 and 104. However, the score line 52 extends from the junction 104, in a manner outwardly bowed away from the row of bottom closure sub-panels but towards the hole 40, to the adjacent score line 50 bounding the body sub-panel 38. The score line 98 is rectilinear and extends obliquely, at a greater angle than does the score line 102, from the junction 67 towards the row of bottom closure sub-panels to a point on that score line 50 spaced away from the point where the score line 52 meets that score line 50. From the point where the score line 98 meets that score line 50 extends a score line 118 bowed towards the row of bottom closure sub-panels but away from the hole 40. The score line 118 terminates short of the score line 102 at a location intermediate the end regions of that score line 102. The score lines 52 and 118 thus bound between them a sub-sub-sub-panel 120 in the form of a narrow-waisted strip. In the fifth panel 12, the score line 112 is curved correspondingly to the score line 106, whilst the obturating sub-panel 110 is formed with an oblique score line corresponding to the outer score line 116 and extending to the adjacent junction 104. In the embodiment of FIG. 16, the sub-sub-sub-panel 120 in the asymmetrical carton formed provides relatively smooth transition between the vertical body sub-panel 36 and the triangular sub-sub-sub-panel 119 defined by the score lines 98, 102 and 118.

Figure 17:
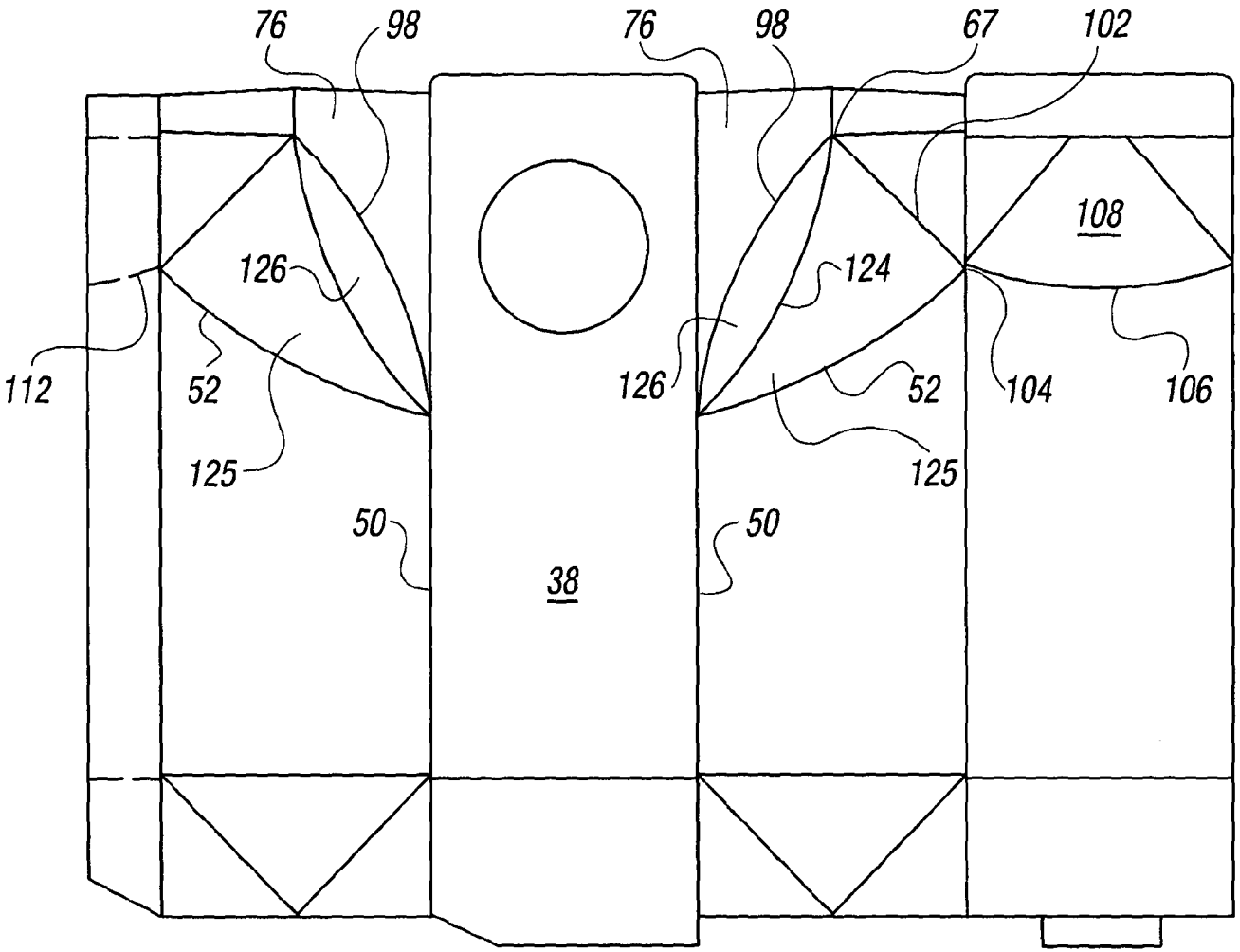

The blank shown in FIG. 17 has some similarities with that shown in, say, FIG. 14. However, the oblique score line 52 is bowed towards the row of bottom closure sub-panels and extends from the junction 104 to the score line 50 bounding the body sub-panel 38. The curved score line 98 extends from the junction 67 to that end of the score line 52 further from the junction 104. There extends from one end to the other of the score line 98 a score line 124 which is bowed away from the score line 98 so as to form therebetween a lenticular sub-sub-sub-panel 126. The blank of the embodiment of FIG. 17 provides not only an asymmetrical gable-topped carton, but also the lenticular sub-sub-sub-panels 126 determine and support the desired curvature of the front roof part of the carton as well as providing transitions between the triangular sub-sub-sub-panels 125 and the combined sub-panels 76.

Figure 18:
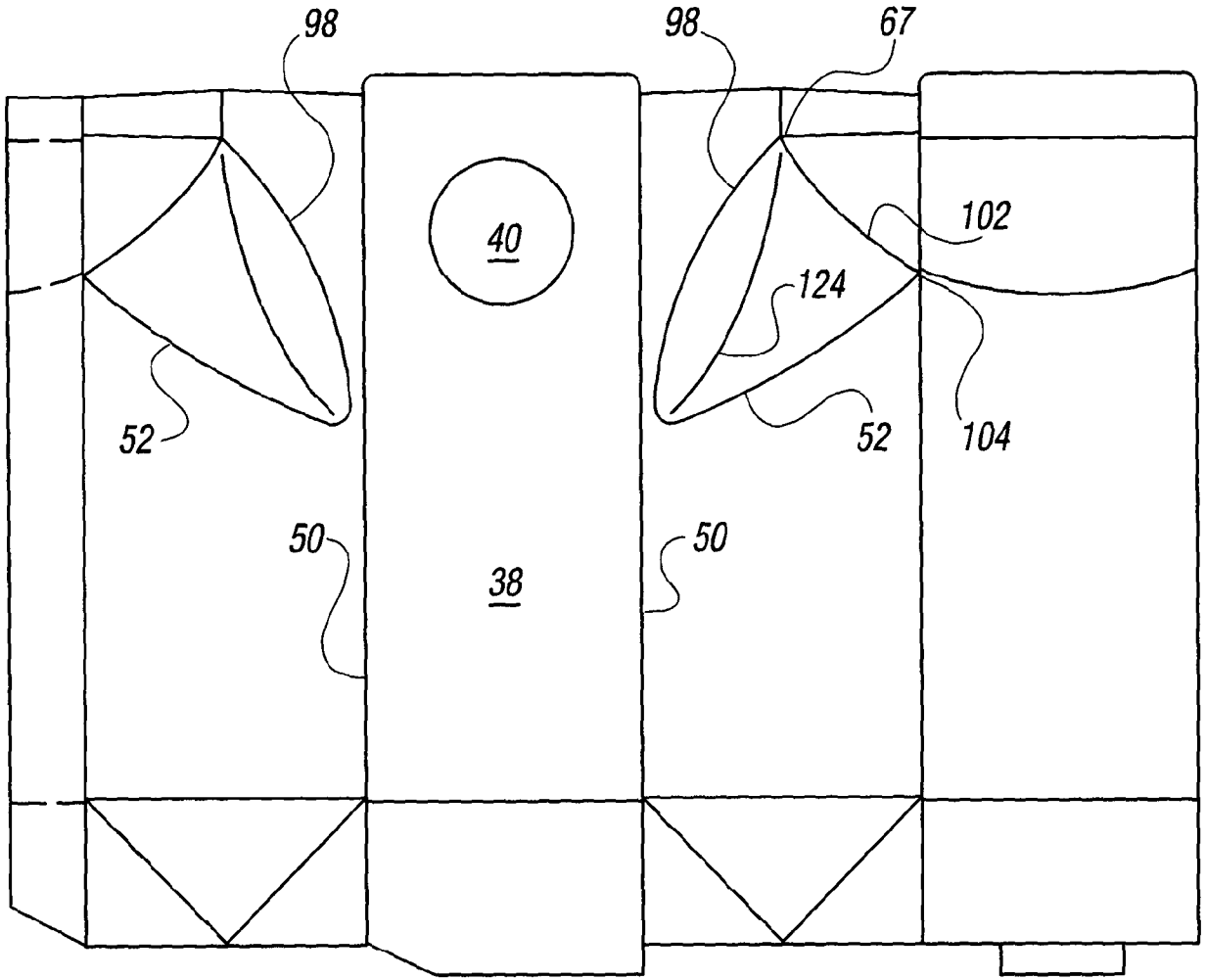

The blank shown in FIG. 18 differs from that shown in FIG. 17 in three respects. Firstly, those end regions of the score lines 52 and 98 nearer the sub-panel 38 merge into each other in a rounded manner and are spaced from the adjacent score line 50. Secondly, the score line 124 stops short of that rounded merging and also stops short of the junction 67. Thirdly, the score line 102 is bowed towards the body sub-panel 38.

Figure 19:
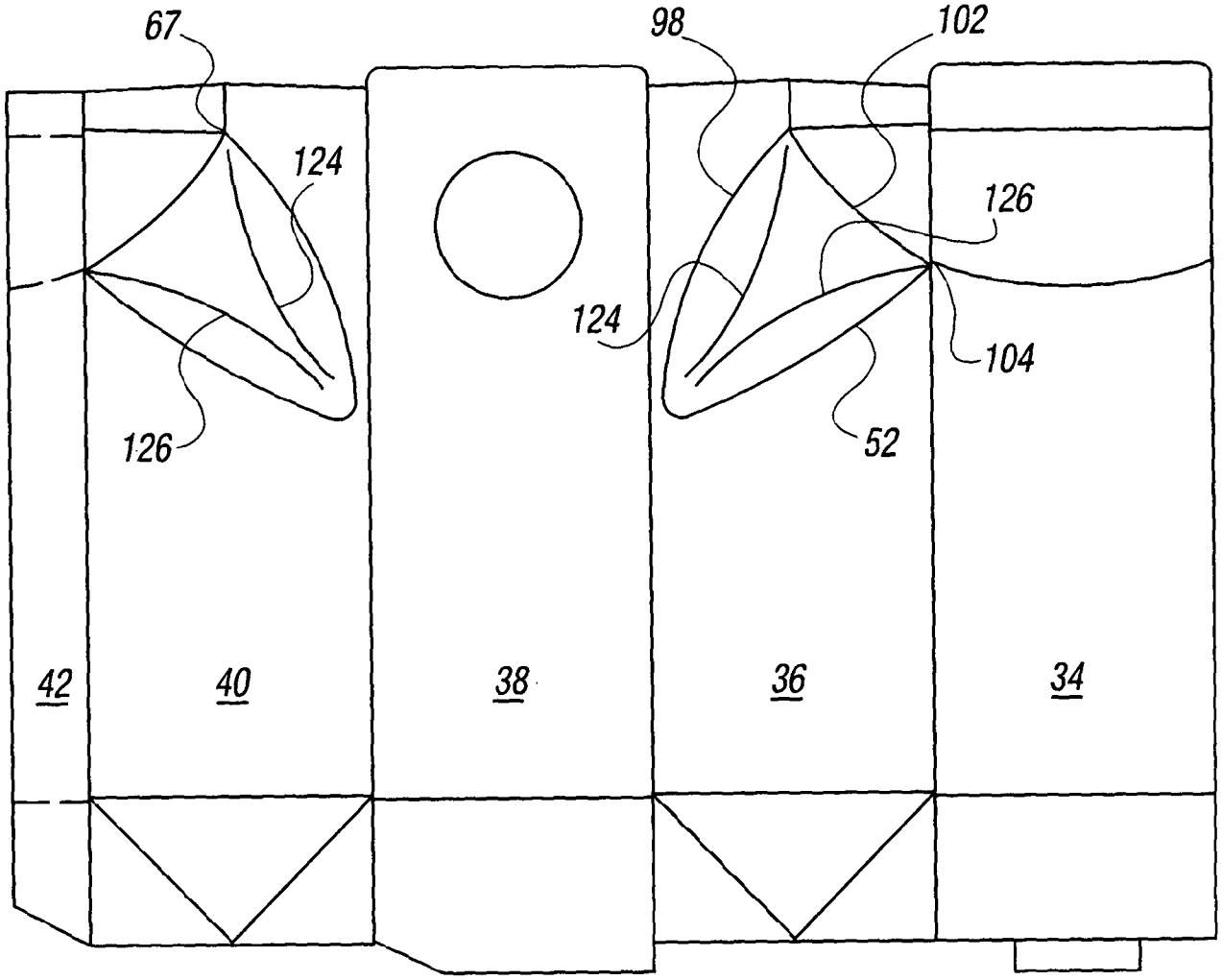

The blank shown in FIG. 19 differs from that shown in FIG. 18 in that a score line 126 extends from the junction 104 and is bowed away from the score line 52 to adjacent (but not meeting) that end of the score line 124 nearer the sub-panel 38. Except at the junction 104, the score line 126 is also spaced from the score line 52. The additional score line 126 in FIG. 19 and forming with the score line 52 a substantially lower, substantially lanceolate leaf, helps to avoid sideways bulging of the upper part of the body sub-panel 36 which might occur with the embodiment of FIG. 17 or 18.

Figure 20:
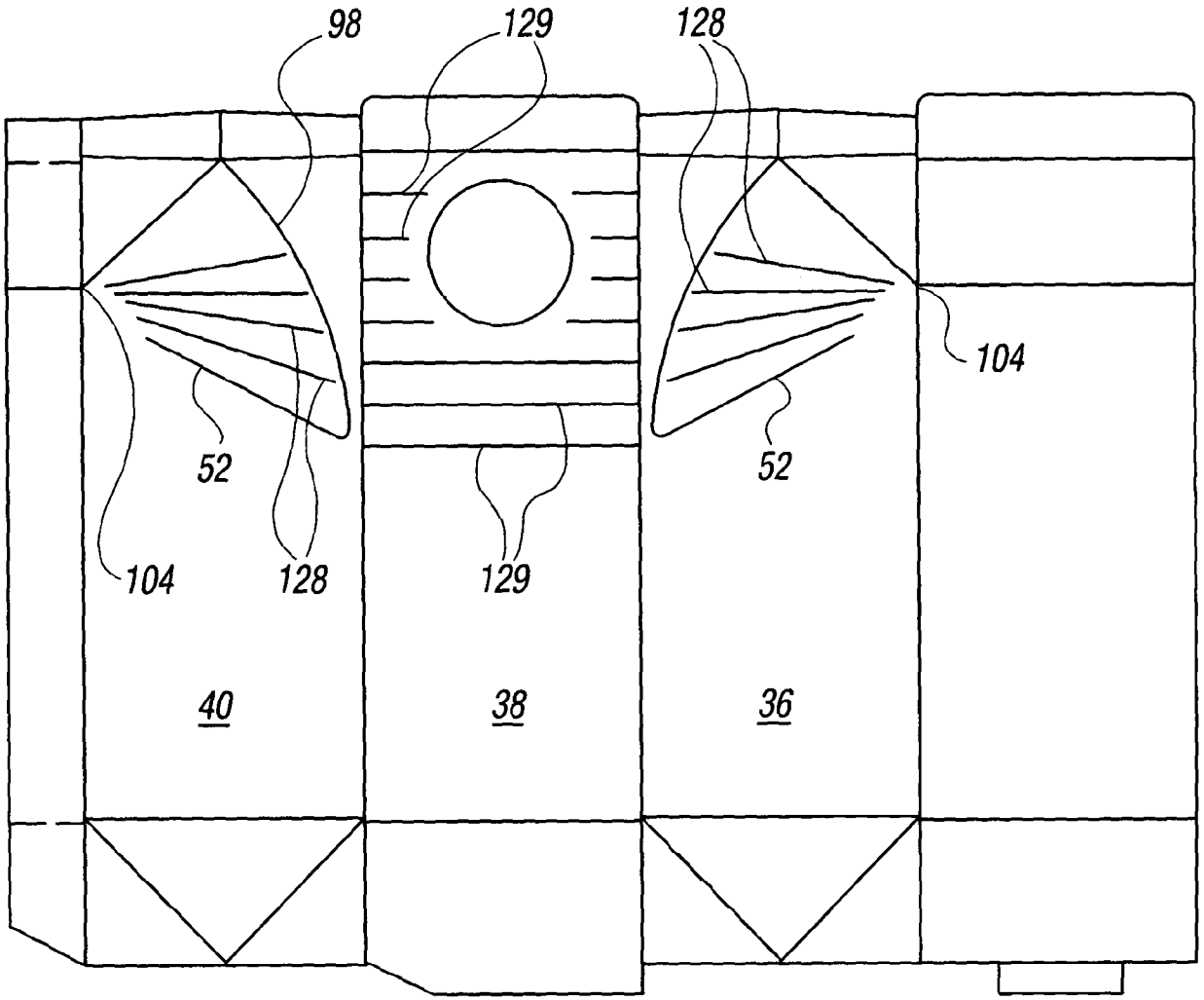

The blank shown in FIG. 20 differs from that shown in FIG. 14 principally in that the score line 52 stops short of the junction 104 and that radiating away from that junction 104 is a fan of score lines 128 which do not extend to the junction 104 and which terminate short of the score line 98. Furthermore, the upper part of the sub-panel 38 is formed with score lines 129 along the row of panels 4 to 12. The fan of score lines 128 provides very good transition curvature upwards from the body sub-panel 36 or 40. The score lines 129 transversely of the front roof part again facilitate the obtaining of the desired curvature of that roof part.

Figure 21:
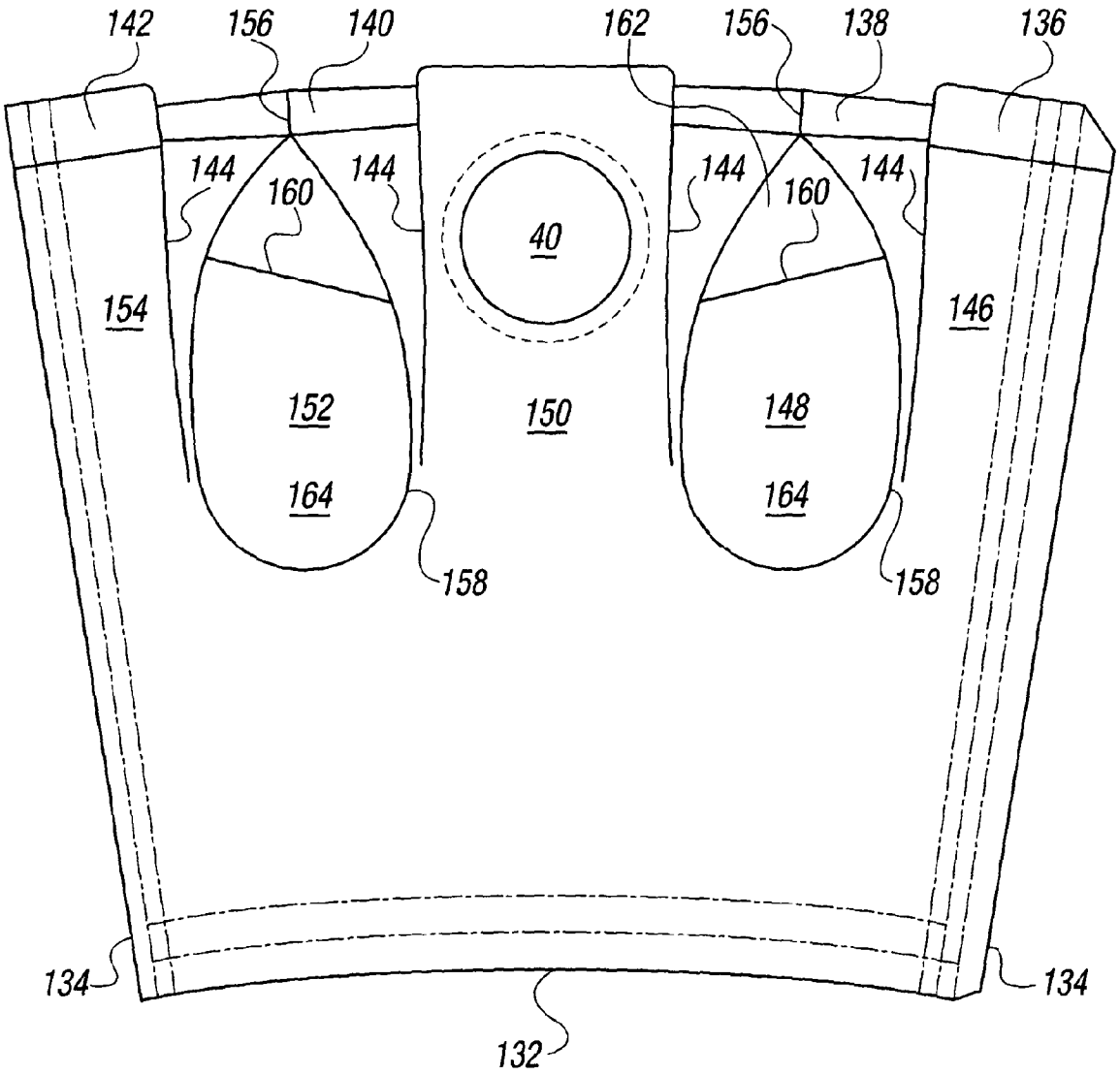

The blank of FIG. 21 has a bottom edge 132 which is concave, rectilinear lateral edges 134 diverging away from each other, and a sequence of top sealing panels 136, 138, 140 and 142 which are generally arranged on a curve substantially concentric with the curve of the edge 132. Score lines 144 extending from the top edge of the blank and terminating part-way down the blank divide the upper part of the blank into three-sided panels 146, 148, 150, 152 and 154. From short score lines 156 which divide the sealing sub-panels 138 and 140 into substantially identical sub-sub-panels, there extends downwardly a score line 158 in the form of a closed loop which, from the score line 156, broadens progressing downwardly to become just spaced from the adjacent score lines 144 and extends a short distance beyond the lower ends of the score lines 144. Each score line 158 is somewhat pear-like in shape and across and within the upper part thereof extends a score line 160 which divides the area enclosed by the score line 158 into an upper sub-sub-panel 162 of substantially triangular shape and a lower sub-sub-panel 164 of a somewhat oval shape. The blank of FIG. 21 is intended to be formed into a longitudinally sealed cone and then have a cup-form base sealed thereto before it is filled and top-sealed. It is designed so that it has a rectangular top and a circular bottom. The blank shown in FIG. 21 has the advantage that the gable ends of the carton formed from the blank and the base cup are each of an almost oval shape owing to the shape of the score lines 158. This tends to be a stronger shape than the traditional, substantially triangular gable end. The short score lines 160 are not essential but they help to encourage inward bending of the parts above them. The score lines 144 may be extended to the bottom of the carton, or the score lines 158 may be extended in that manner. The upper parts of the score lines 144 and 158 provide the substantially square upper portion of the carton, whilst the lower parts of the score lines 144 and 158 provide the transition from square cross-section to circular cross-section. It will be noted that the blank is for a carton having a centre seam, rather than the side seam of the cartons described hereinbefore.

Figure 22:
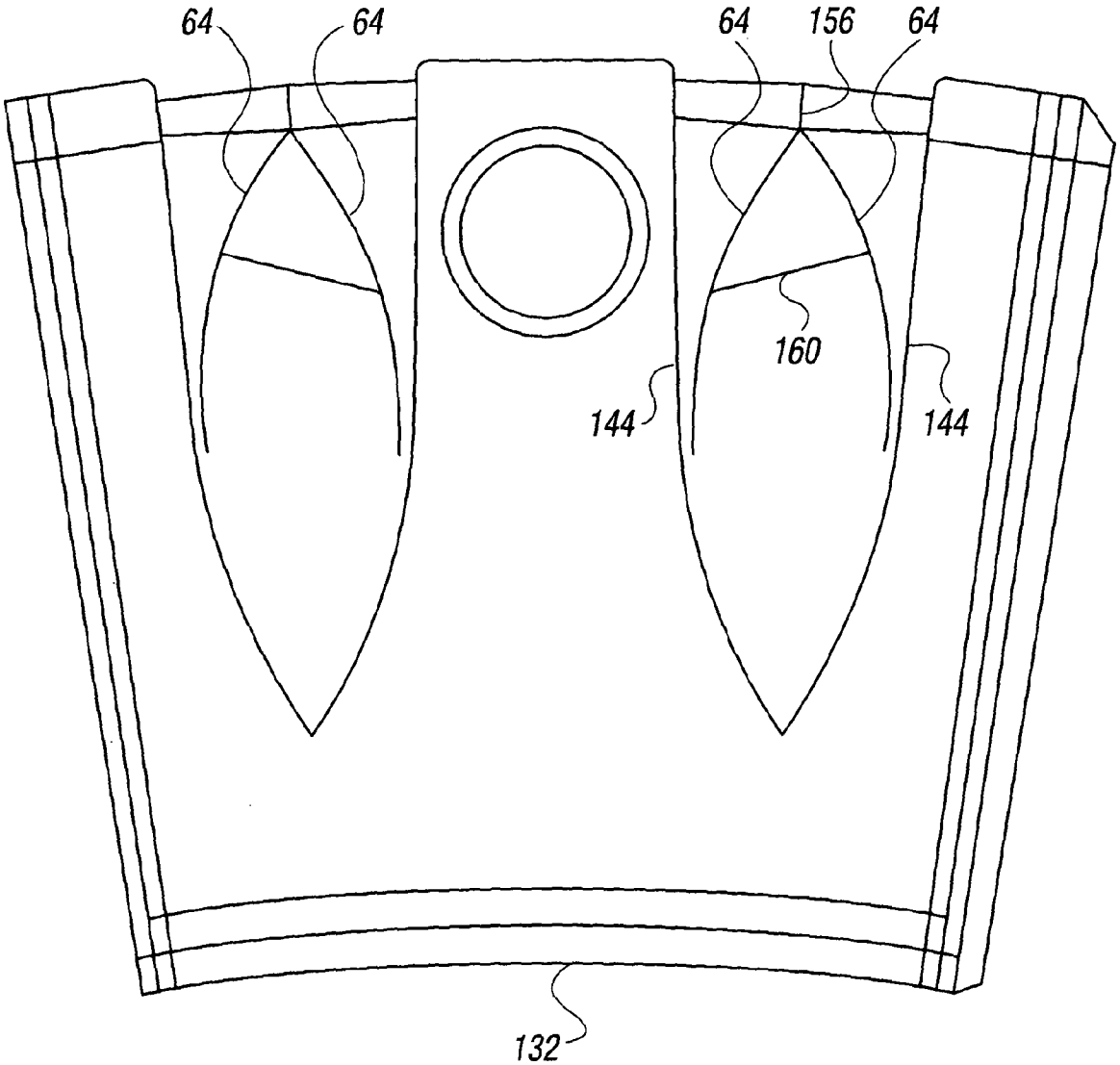

The blank shown in FIG. 22 differs from that shown in FIG. 21 in a number of respects. Firstly, the lower part of each score line 158 is omitted to provide two score lines 64 which extend downwardly from the score line 156 to close to the respective adjacent score lines 144, whilst those adjacent score lines 144 continue beyond the score lines 64 to meet symmetrically at a location closer to the bottom edge 132 of the blank than to the top edge thereof. The transition from the square-section top of the carton to the circular-section bottom of the carton is achieved by extension downwards of the score lines 144.

Figure 23:
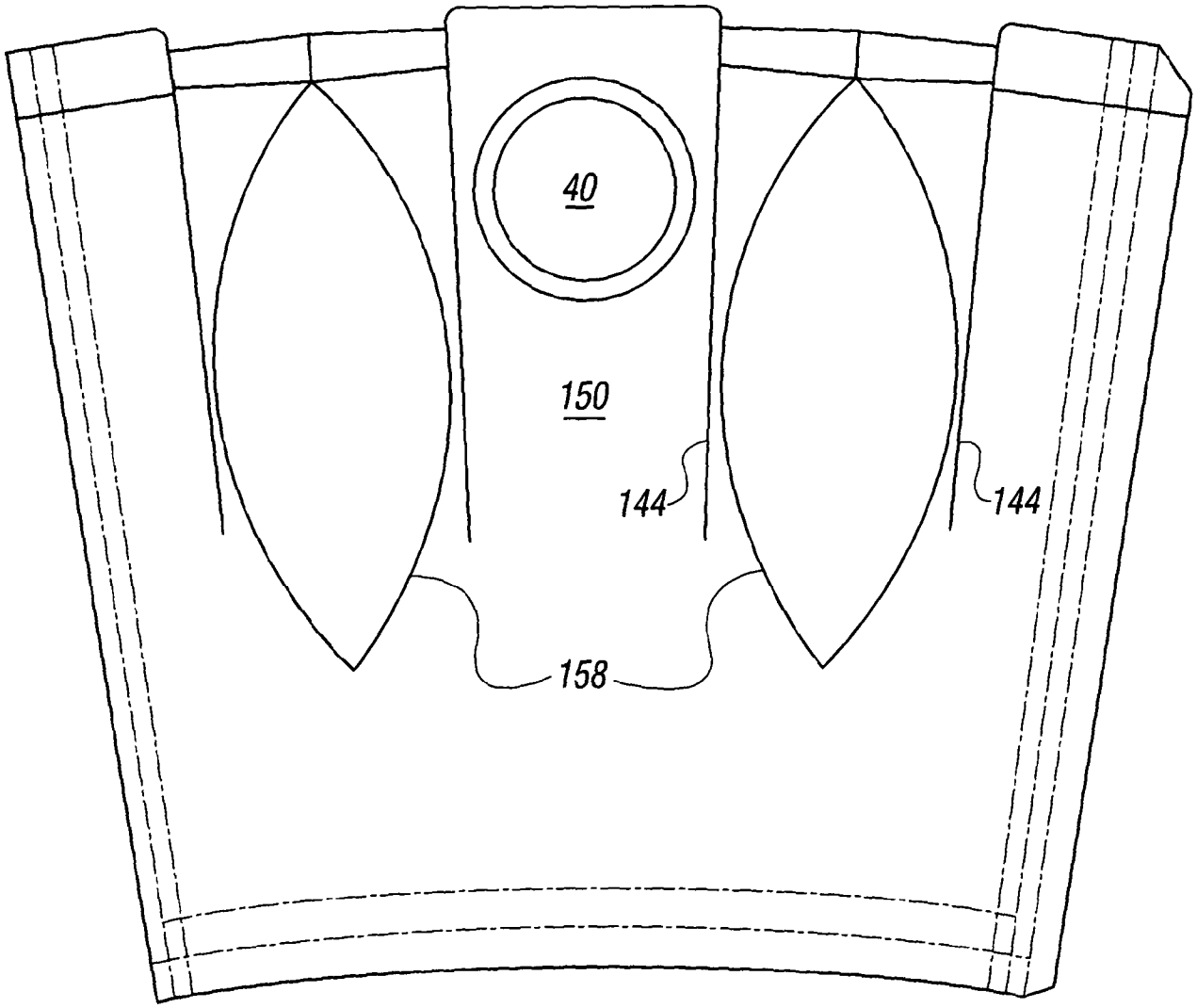

The blank of FIG. 23 differs from the embodiment shown in FIG. 21 in that each score line 158 in the form of a closed loop is lenticular in shape and in that the score lines 160 have been omitted.

Figure 24:
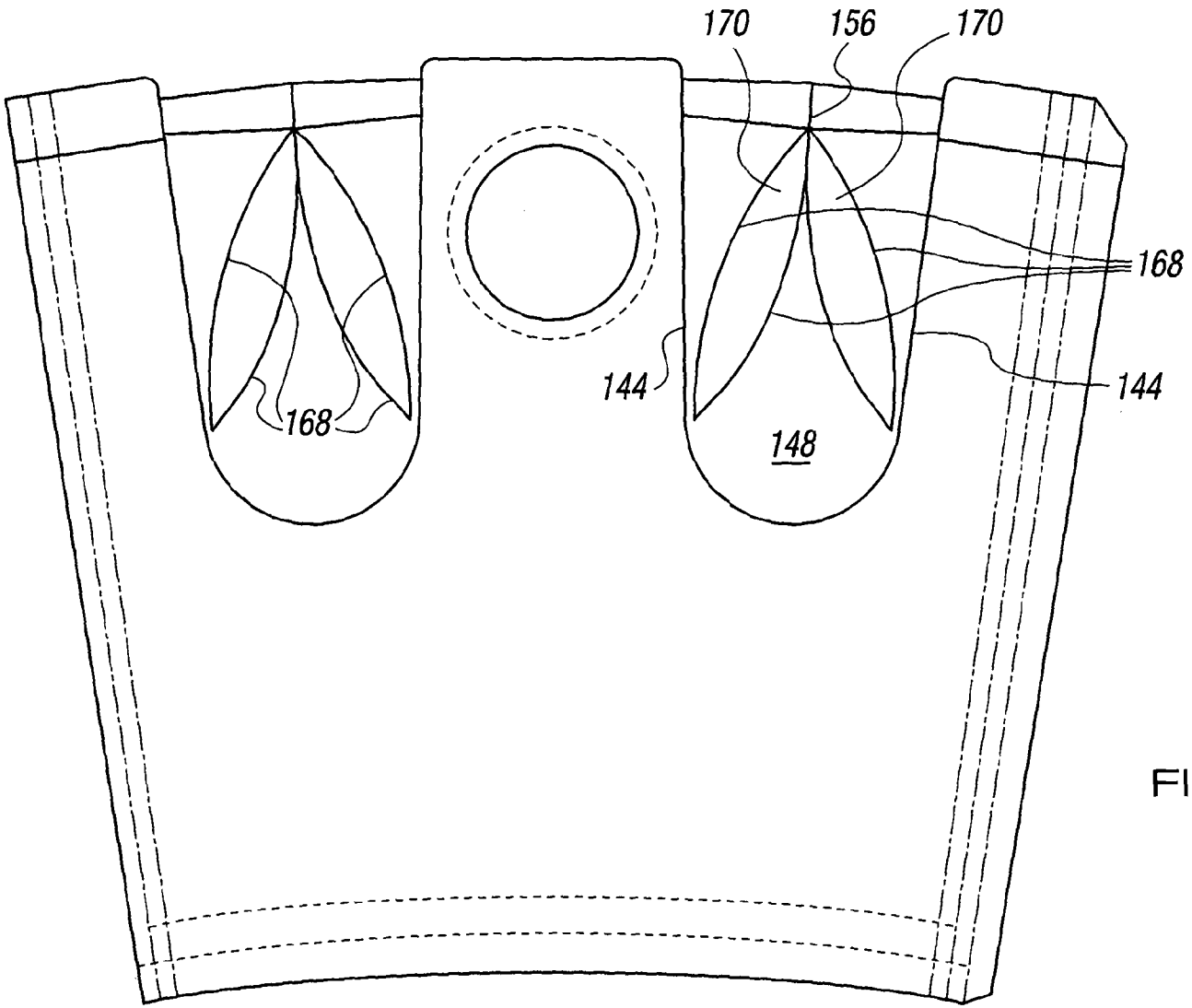

The blank shown in FIG. 24 is significantly different from that shown in FIG. 23 in that each pair of score lines 144 at their lower regions extend towards each other and merge in a rounded manner, whilst extending downwardly from each score line 156 are two pairs of score lines 168, of which the score lines in each pair are bowed away from each other so as to form a lanceolate sub-sub-panel 170. The score lines 168 extend to short of the lower end regions of the rectilinear sections of the respective adjacent score lines 144. The lanceolate sub-sub-sub-panels 170 again define and support the curvature of the front and rear roof parts of the carton, whilst the omission of any score line joining the lower ends of those sub-sub-sub-panels enables the board to find its own transition at that location.

Figure 25:
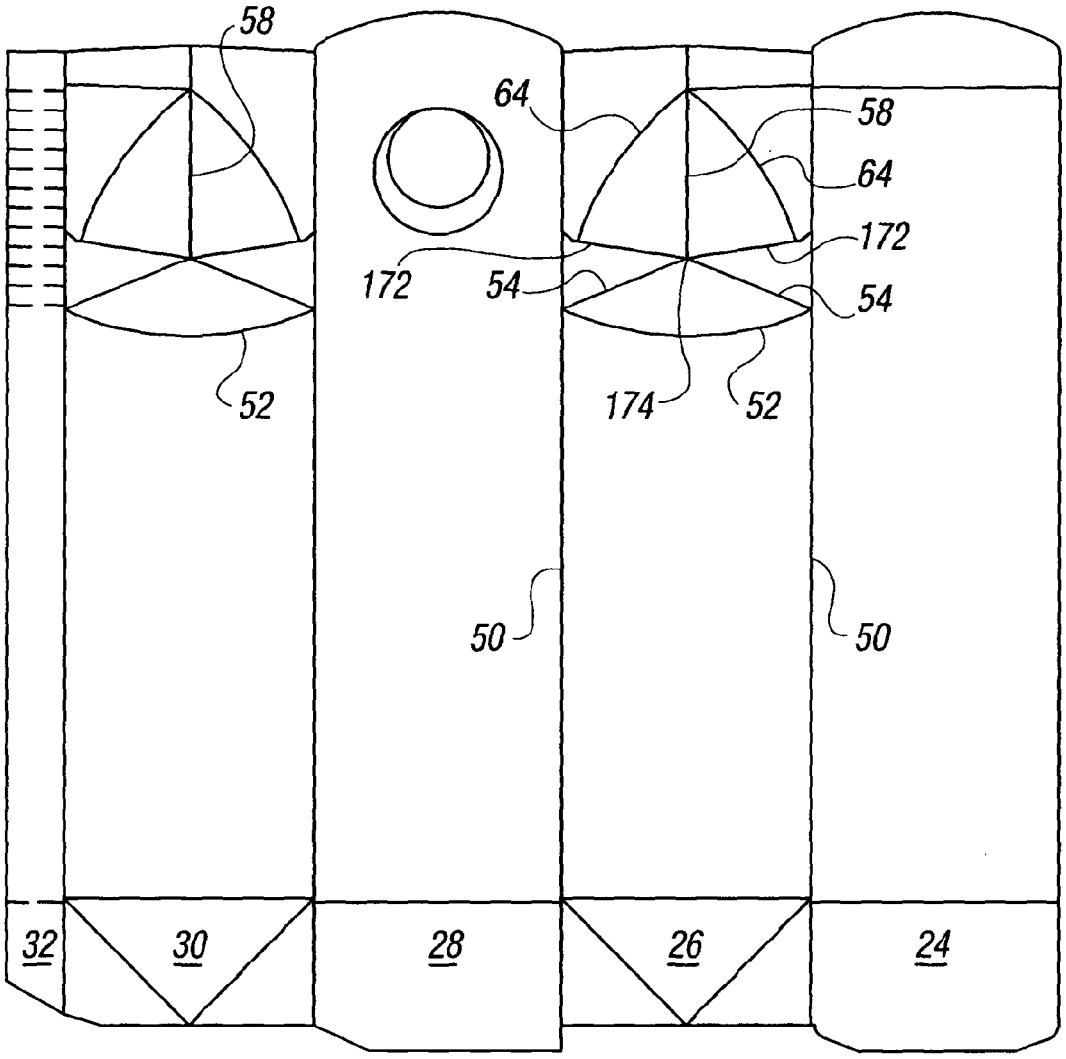

The blank shown in the FIG. 25 is somewhat similar to that shown in FIG. 5; however, the score lines 64 continuously diverge towards the row of bottom closure sub-panels 24 to 32 and meet respective, substantially rectilinear score lines 172 which diverge outwardly away from each other from the junction 174 between the score lines 54 and 58. those end zones of the score lines 172 further from the junction 174 curving away from the row of bottom closure sub-panels to meet the respective score lines 50 relatively gently.

Figure 26:
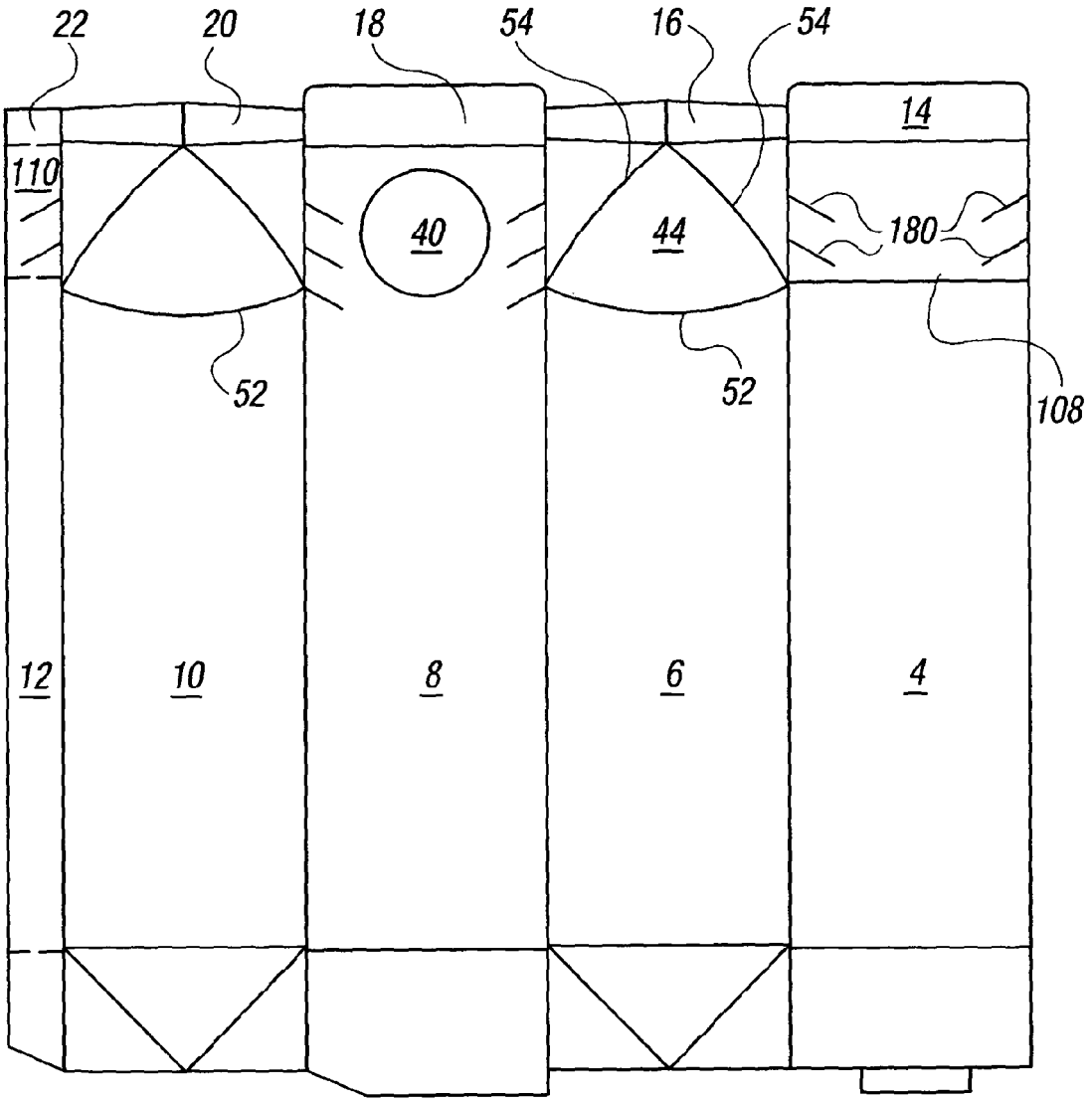

FIG. 26 shows a blank for a relatively traditional gable-top carton. It differs in that the panel 8 does not have below the sealing sub-panel 18 a transverse score line defining a top closure obturating sub-panel, in that the score lines 52 and 54 defining a central, triangular gable-end sub-sub-panel 44 are bowed outwardly away from the middle of that sub-sub-panel, and in that there are short, oblique score lines 180 extending from the edges of the panels 4, 8 and 12 inwardly at about the level of the top closure obturating sub-panels 108 and 110. The score lines 180 may instead extend parallelly to the row of sealing sub-panels 14 to 22.

Figure 27:
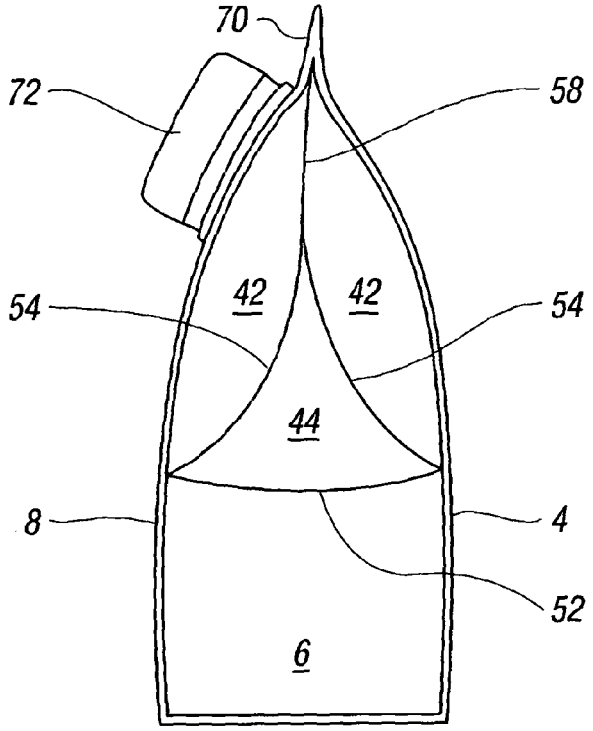
FIG. 27 is an end view of a filled and top-sealed carton of the embodiment of the blank of FIG. 1.

FIG. 27 shows a carton which has been produced from the blank of FIG. 1 and has been filled and top-sealed. It will be noted that, compared with a traditional gable top carton, the triangular sub-panel 44 of the gable end is at a much lower level than in the traditional carton. As a consequence, the panels 4 and 8 begin to converge upwardly towards each other at a lower level than traditionally. Although in FIG. 27 the panels 4 and 8 curve towards each other from the level of the score lines 52, in practice they may well extend rectilinearly towards each other to the sealing fin 70. Whatever those circumstances, the lower the score line 52, the more the upper parts of the panels 4 and 8 tend to be unable to maintain their shape during production and transport. However, that potential drawback is offset by the potential benefit that, the lower the score line 52, the less need there may be for insertion of an anvil into the open-topped carton to support the top closure panels during top pre-breaking, thus reducing mechanical complication and potential contamination of the interior of the carton. There is additionally an actual benefit in that there is less restraint on the size (i.e. width) of the fitment 74, so that the fitment can be relatively larger. Furthermore, the sharper wedge shape of the carton has improved ergonomic properties, in particular for holding and for support during pouring.

An advantage of having a more acutely wedge-shaped carton, such as in FIG. 27, is that it is possible actually to omit the score lines 15 and 19 so that, at both the rear and the front of the carton, at least the upper half of each panel 4 and 8, or even each panel 4 and 8 from an outermost boundary of the body sub-panel 34 or 38 to an outermost boundary of the top sealing fin, is substantially free from any lines of weakness extending inwardly from lateral edge zones of the panel 4 or 8. As a result, artwork can occupy the outer surfaces of those parts of the panels 4 and 8 without any interruption by transverse score lines. Furthermore, the panels 4 and 8 can approach the top edge of the sealing fin more smoothly than conventionally.

Figure 28:
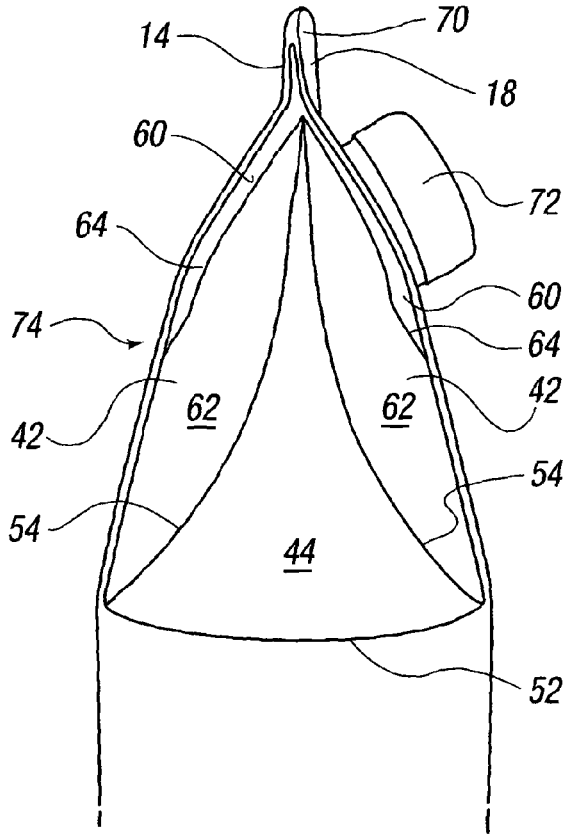
FIG. 28 is a fragmentary end view of a filled and top-sealed carton of the embodiment of the blank of FIG. 3.

Referring to FIG. 28, there are seen the score lines 52, 54 and 64, and the sub-sub-panel 44, the sub-sub-sub panels 60 and 62, and the sub-panels 14 and 18 which have been sealed together to form a top sealing fin 70. Also seen is the pour spout fitment 72 which has been inserted into the hole 40 from the inside of the carton 74 prior to filling and sealing of the carton 74. The advantage of the score lines 64 is that they enable the sub-sub panels 42 and 46 to fold to provide the sub-sub-sub panels 60 to support the curved forms of the upper parts of the sub-panels 34 and 38. Thus, they not only determine but also maintain the particular desired curvature thereof. Again, the location of the score lines 52 on the sub-panels 36 and 40 transversely of the row of panels 4 to 12 tends to determine where the upper parts of the sub-panels 34 and 38 begin to converge inwardly towards the sealing fin 70.

Figure 29:
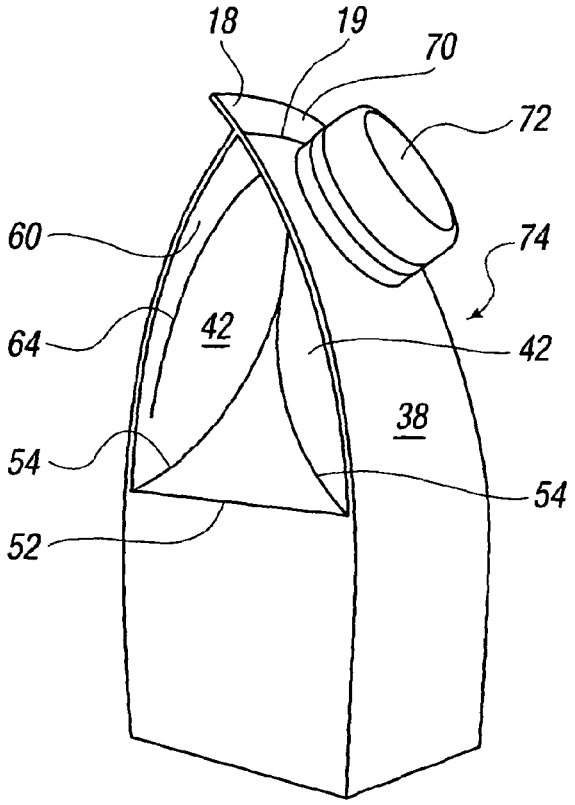
FIG. 29 is a perspective view of a filled and top-sealed carton of the embodiment of the blank of FIG. 4.

Referring to FIG. 29, again there can be seen the score lines 19, 52, 54 and (one of) 64, as well as the pour spout fitment 72. Instead of the sealing fin 70 being vertical, it is inclined obliquely away from the pour spout 72 so as to give a relatively smooth appearance to the front of the carton, i.e. to the outer surfaces of the sub-panels 18 and 38. This has been achieved by appropriate angling of the sealing jaws employed to form the top fin and can be assisted by the omission of the score line 19, which enables the front sub-panel 38 to extend smoothly from the bottom closure of the carton to the top edge thereof. Again, as described with reference to FIG. 28, the score lines 64 have the effect of allowing the sub-sub-panels 42 and 46 to bend, so as to provide the equivalent of the sub-sub-sub-panels 60 to define the curvature of the roof parts of the rear and front sub-panels 34 and 38 and to support that curvature. The Gothic arch provided by the sub-sub-sub-panels 60 is very effective for those purposes.

Figure 30:
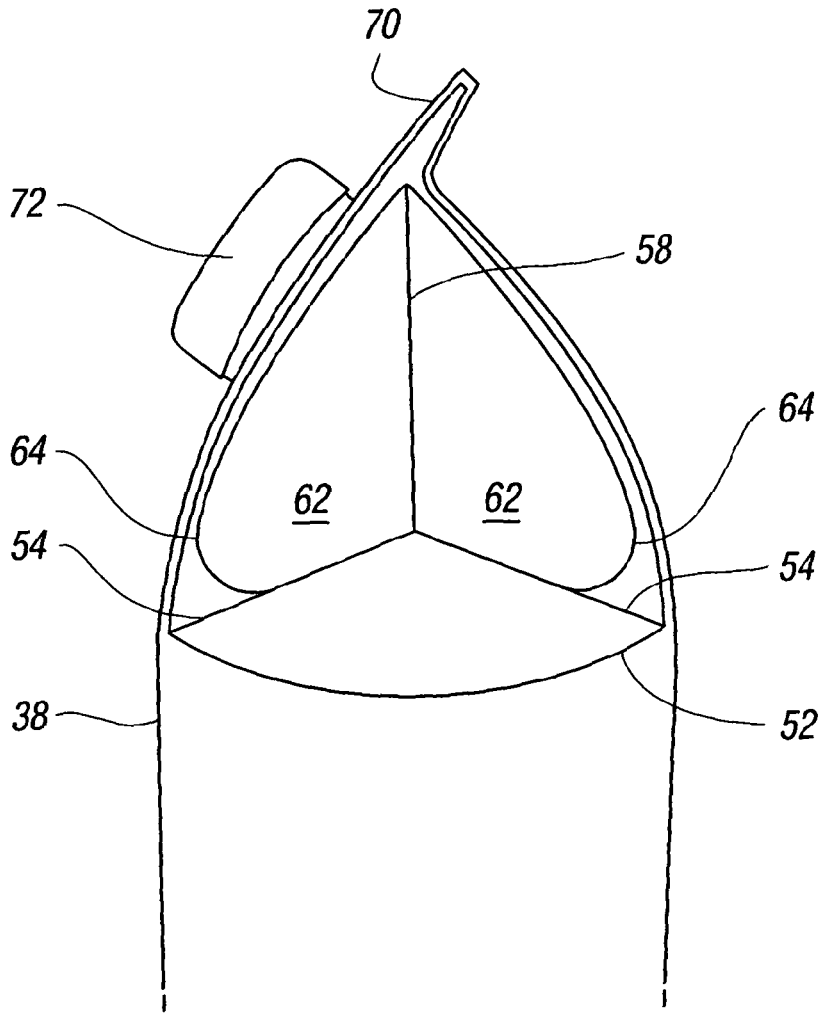
FIG. 30 is a view similar to FIG. 28, but with the carton being of the embodiment of FIG. 5.

There can be seen in FIG. 30 the score lines 52, 54, 58 and 64, as well as the sub-sub-sub-panels 62. There is also seen the fitment 72, and also the sealing sub-panel 70 substantially co-planar with the front roof part. The arrangement in which the score lines 64 approach but do not contact the respective adjacent score lines 50 has the advantage of providing a transition between them and so tends to avoid cracking of the board which might otherwise occur. Furthermore, the arrangement in which the score lines 64 do not meet the score line 52 at the end thereof or the score lines 54 at the ends thereof has the advantage of avoiding the cracking in the board which might otherwise occur if a multiplicity of score lines were to meet at a junction.

Figure 31:
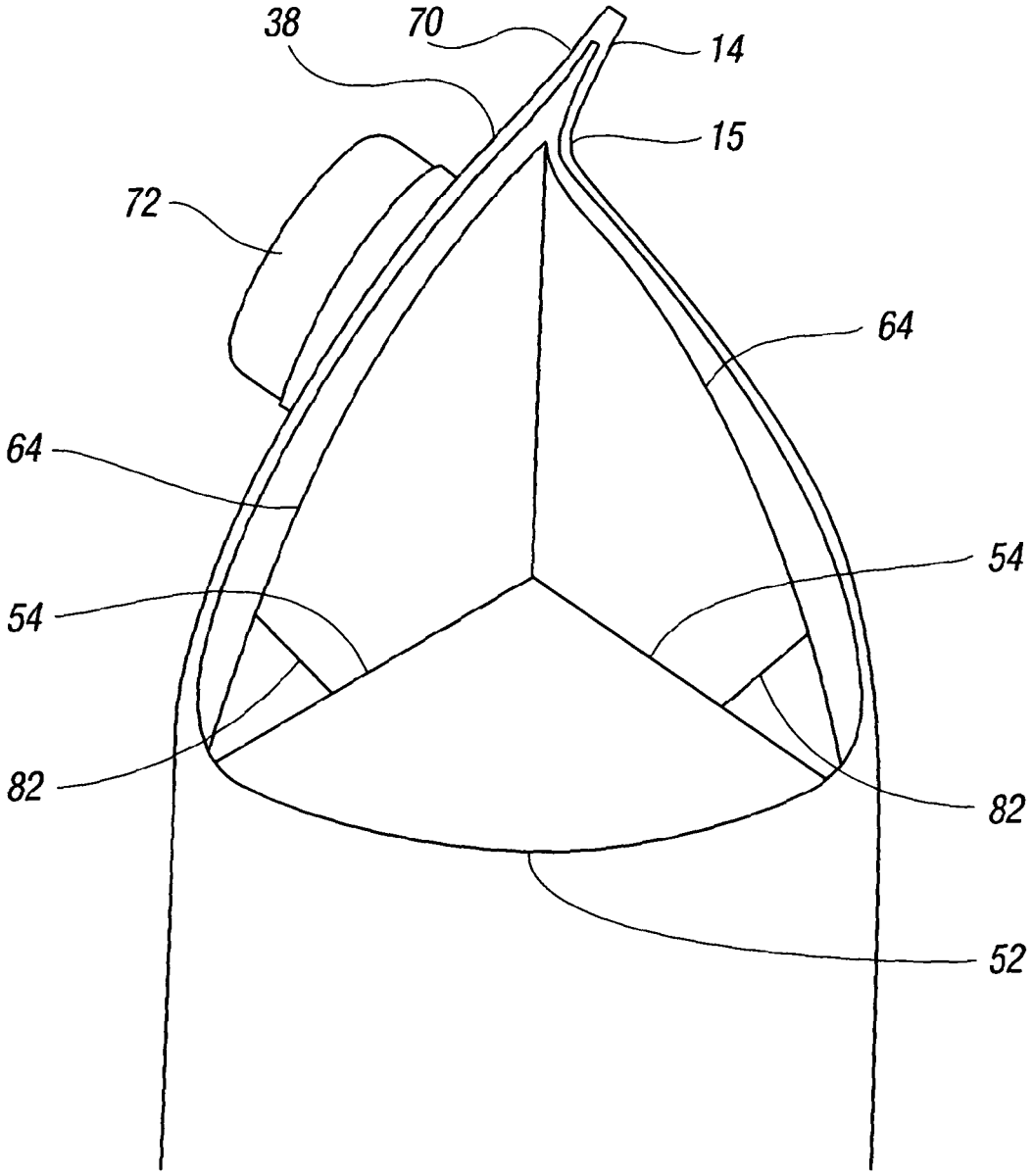
FIG. 31 is a view similar to FIG. 28, but with the carton being of the embodiment of the blank of FIG. 8.

In FIG. 31 the score lines 52, 54, 64 and 82 are seen and the score line 15 is indicated at the base of the sealing sub-panel 14. A pour spout fitment 72 is also seen, which has been inserted through the hole 40 from the inside of the carton prior to filling and top-sealing of the carton.

Figure 32:
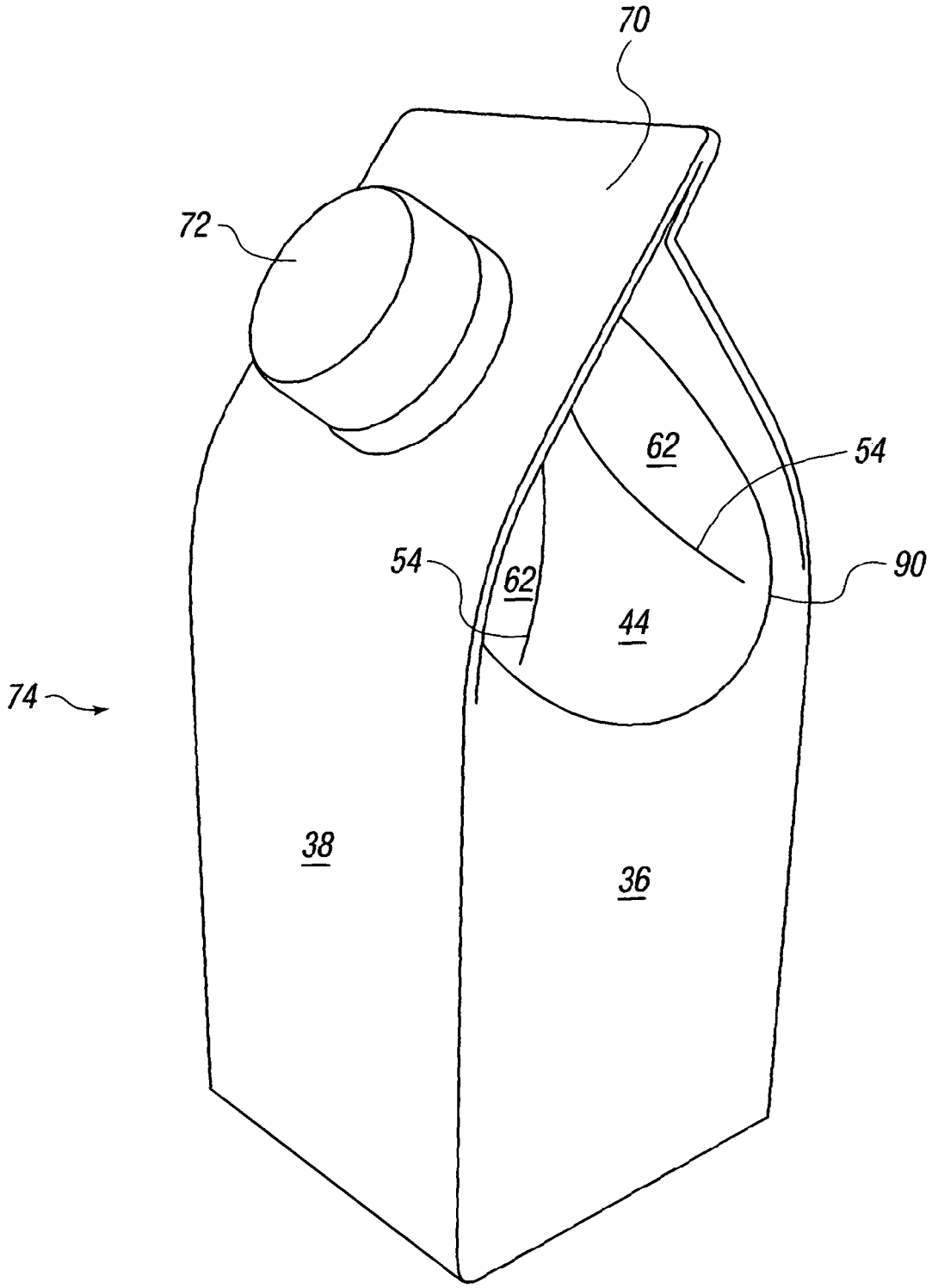
FIG. 32 is a perspective view of a filled and sealed carton of the embodiment of the blank of FIG. 11.
Figure 33:
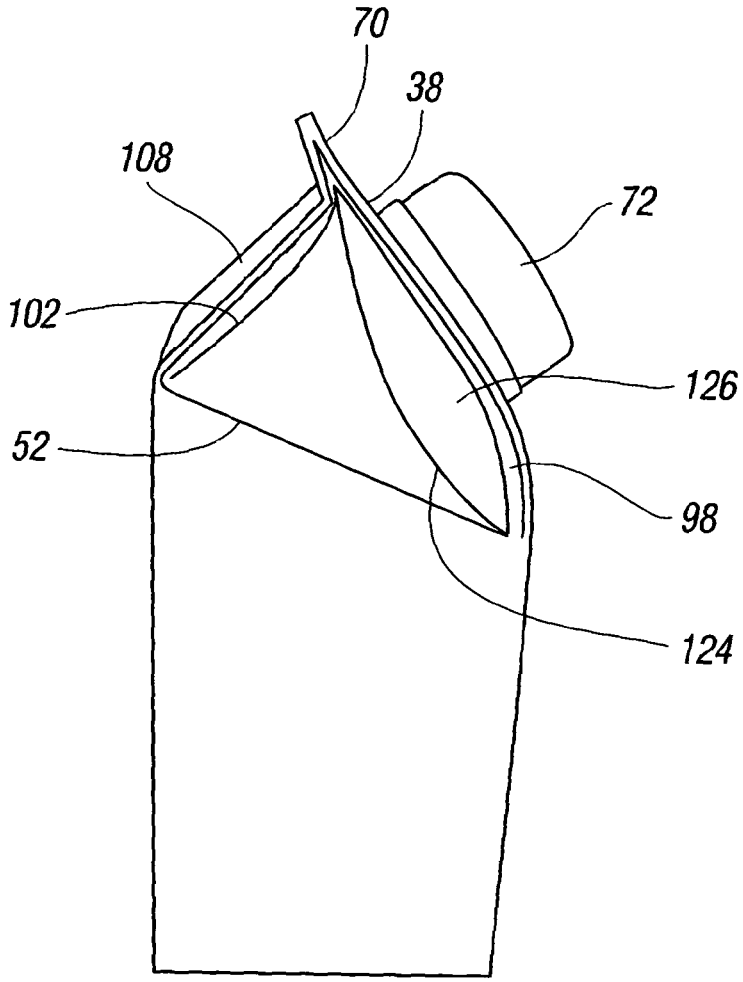
FIG. 33 is an end elevation of a filled and sealed carton of the embodiment of the blank of FIG. 20.

Referring to FIG. 32, there can be seen the score lines 54 and 90. The effect of the provision of the substantially lenticular sub-panels 62 is to support and define the curvature of the upper parts of the body sub-panels 34 and 38. The downward curvature of the lower part of the score line 90 allows a more natural bend of the lower part of the body sub-panel 36 into the substantially triangular sub-panel 44 defined among the score lines 54 and the score line 90.

Figure 34:
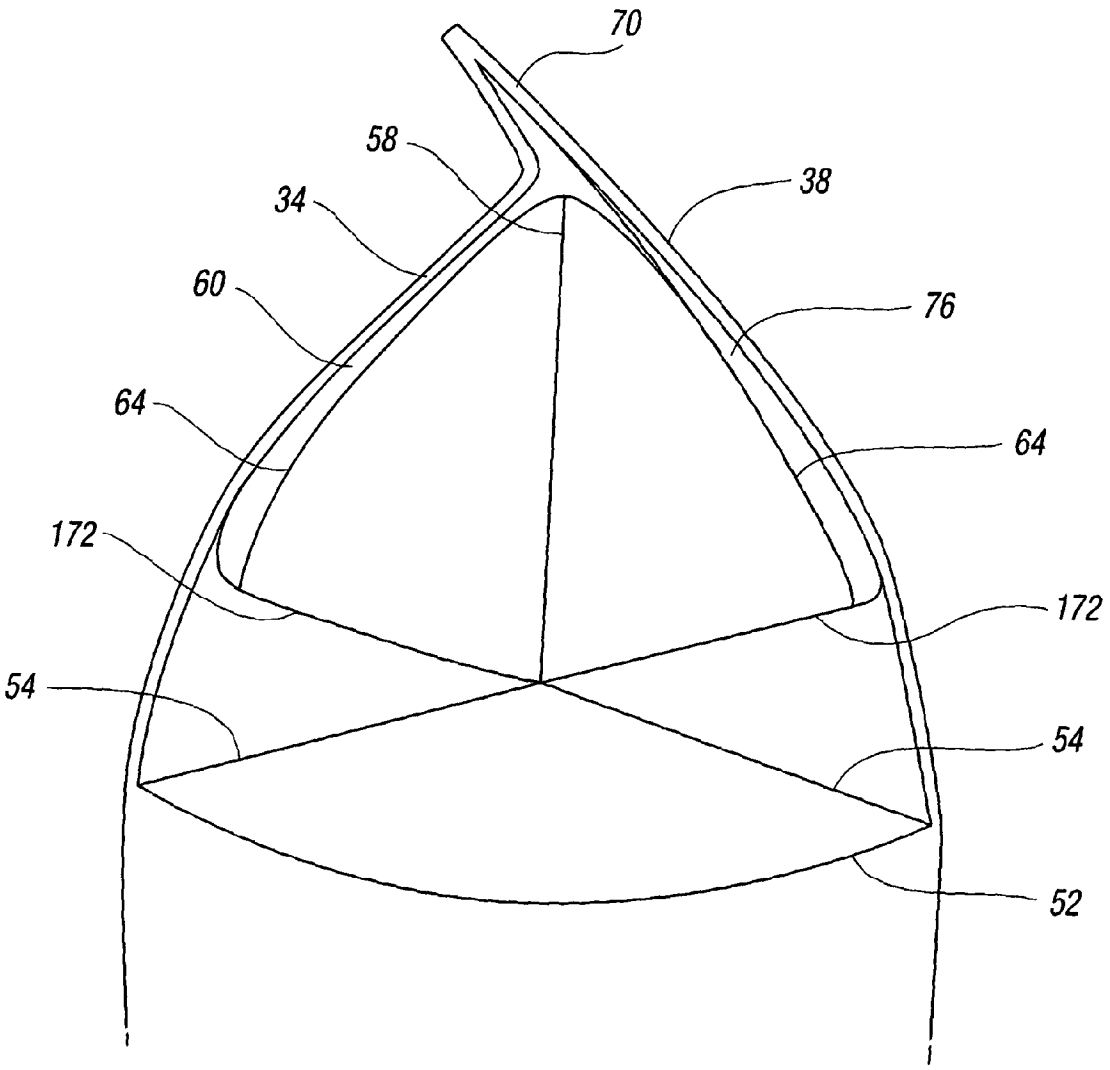
FIG. 34 is a view similar to FIG. 28, but with the carton being of the embodiment of the blank of FIG. 25.

FIG. 34 is a fragmentary side view of the upper part of a gable-top carton produced from the blank of FIG. 25 and filled and top-sealed, and with a pour-spout fitment (not shown). The arrangement of the score lines 54, 58 and 172 in the form of spokes of an umbrella provides an array of sub-sub-sub-panels therebetween which tends to strengthen the top closure and, combined with the effects of the sub-sub-sub-panel 60 and the combined sub-panel 76, tends to maintain the desired curvature of the upper parts of the rear and front sub-panels 34 and 38. Furthermore, during top pre-breaking and top folding, that arrangement of radiating spokes facilitates inward folding of the gable end, since only a relatively light inward force at the centre of the arrangement is required to produce correct folding and it may even be possible to avoid the need to use an anvil internally of the carton during top pre-breaking.

Figure 35:
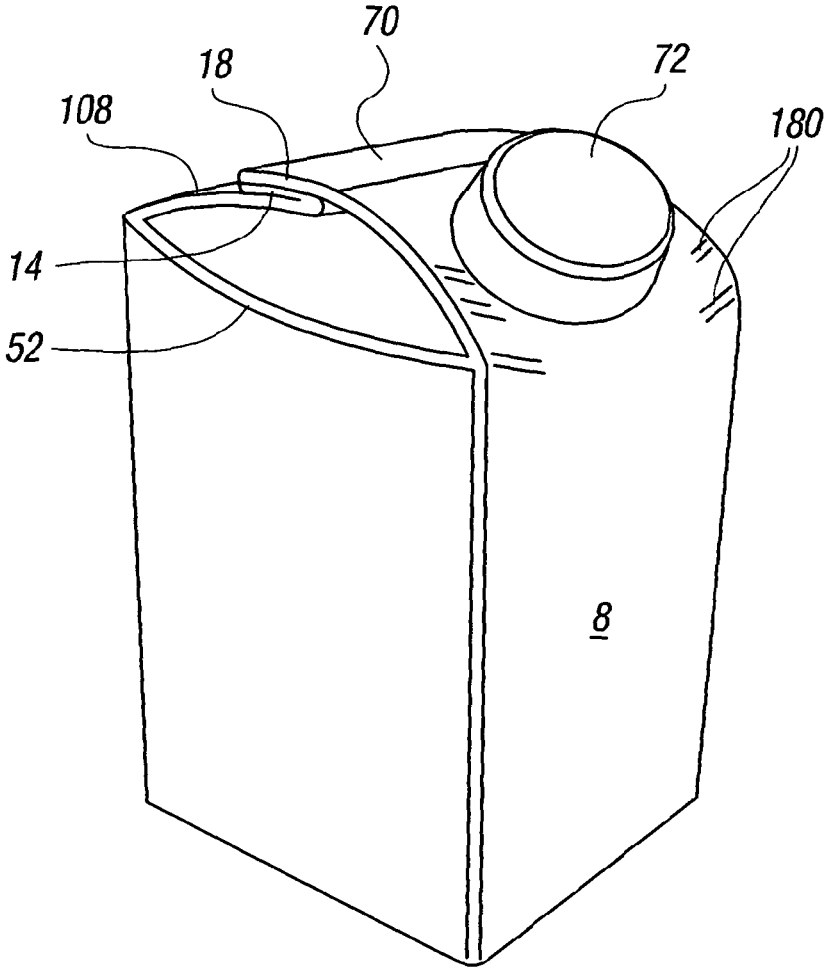
FIG. 35 is a perspective view of a filled and sealed carton of the embodiment of the blank of FIG. 26.

There is seen in FIG. 35 the score line 52, the sealing fin 70 formed by sealing together the top closure sealing sub-panels 14 and 18, the score lines 180, and the pour spout fitment 72 which in this instance is of the type having a screw cap. The sealing fin 70 has been turned backwards and downwards and sealed, for example by hot melt, to the outer surface of the rear obturating sub-panel 108. In this way, the sealing fin 70 is prevented from obstructing the opening of the fitment 72 by the consumer and from obstructing the drinking of the content out of the opened fitment 72. This is particularly advantageous for small gable top cartons, especially so-called "portion packs". That feature is also advantageous if the fitment is a hatch-type fitment or if there is present instead a pierceable straw-hole. The downward bowing of the score line 52 at each gable end facilitates insertion of the thumb and fingers of a hand for carrying the carton. The presence of the fitment 72 has the effect of stiffening the receiving roof part, so that the score lines 180 are employed to weaken that part at its lateral edges, again to facilitate insertion of the thumb and fingers; the score lines 180 also ease the forming of the top section of the carton 74.

Figure 36:
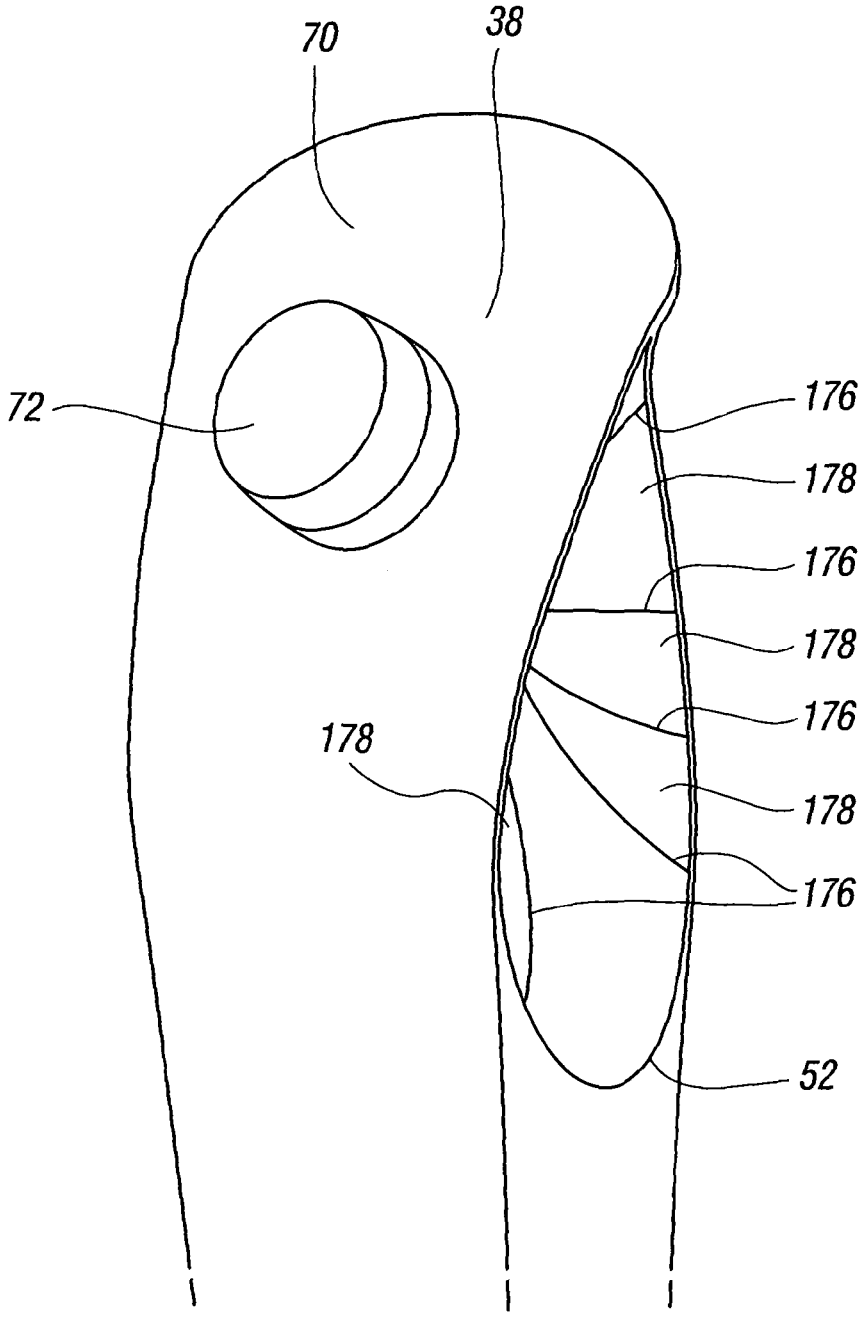
FIG. 36 is a fragmentary perspective view of a filled and sealed carton of a further embodiment.

The carton shown in FIG. 36 differs from that shown in FIG. 34 in a number of respects. Firstly, the score line 52 is so formed as to merge gently into the adjacent score lines 50 so that the corresponding gable end is almost an oval shape, which is relatively stronger than the more triangular gable end shape of the carton of FIG. 34. Secondly, there are significantly more score lines 176 radiating like the spokes of an umbrella from the junction 174 (not seen). This not only facilitates inward folding of the gable end (possibly without use of an anvil), but also means that the sub-sub-sub-panels 178 formed among the score lines 176 support more accurately the desired curvature of the upper parts of the rear and front sub-panels 34 and 38. Furthermore, the sealing fin 70 extends to significantly past the lower edge of the seal of the fin. This facilitates grasping of the carton by a consumer, for example. Following top sealing, it is possible to cut to shape, e.g. to the curved shape shown, the outer parts of the fin, particularly as a final stage on a form-fill-seal packaging machine. The blank from which the carton of FIG. 36 is made has its uppermost sub-panels (14-22) taller than conventional, so providing the additional board required to allow cutting of the fin 70 to shape. The blank is preferably of rectangular form with rectilinear edges. However, to save board and/or to ease the sealing and/or the cutting of the fin 70, the rear panel 4 may remain of substantially conventional height whilst the front panel 8 is taller than conventional, extending at its top beyond the panel 4 and there being cut to shape while the panel 4 remains uncut at its top.

Figure 37:
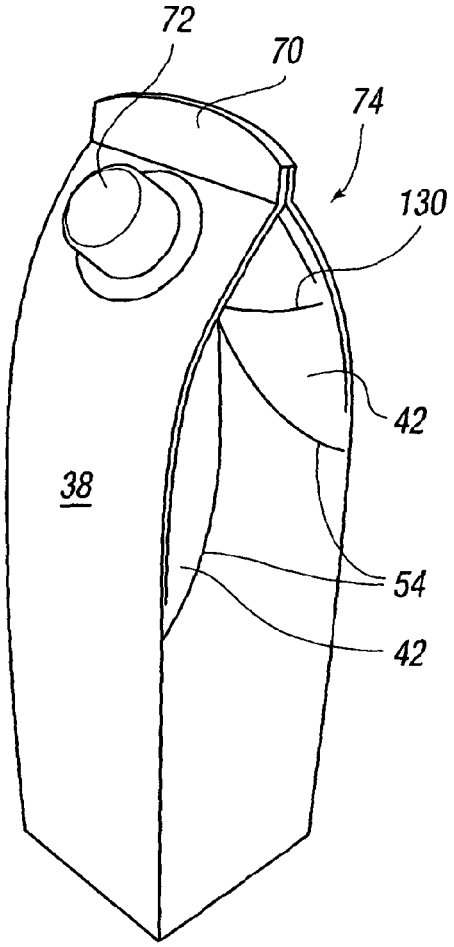
FIG. 37 is a perspective view of a filled and sealed carton of a yet further embodiment.

Referring to FIG. 37, the carton 74 has a vertical sealing fin 70 which is offset rearwards because the carton is asymmetrical to allow the internal dimension of the fitment 72 to be greater than would otherwise be feasible. Each score line 52 has been omitted but the score lines 54 are present, although themselves asymmetrical, in particular each rearward score line 54 extending upwards from a location at its adjacent vertical edge of the carton at a higher level than that at which the forward score line 54 extends from its adjacent upright edge of the carton. Each score line 54 may be one of two or more score lines arranged in a fan formation to assist adaptation of the sub-sub-panel 42 to the curvature of the upper parts of the rear and front body sub-panels 34 and 38. One rearward such additional score line is referenced 130.

What is claimed is:

1. A container comprising a semi-rigid sheet material having a tubular main body and a gable-form part closing said body at one end thereof, said gable-form part comprising an outermost sealing fin, first and second diverging walls extending away from said fin and whereof at least the first wall has outwardly curved inner and outer surfaces, the first wall further having a pour spout fitment attached thereto, first and second gable end walls each extending from the first to the second of said diverging walls and each having at least an upper part which is of substantially triangular outline as seen in end elevation, with an edge thereof at the curved inner surface of said first wall being curved and closely following the curved inner surface, wherein the gable end walls further comprise a lower line of weakness extending substantially across a width of the gable end walls and forming a lower part of said gable-form part.

2. A container according to claim 1, wherein said lower line of weakness is located at a level significantly below said pour spout fitment.

3. A container according to claim 2, wherein the lower line of weakness is downwardly bowed.

4. A container according to claim 1, wherein the lower line of weakness is downwardly bowed.

5. A container according to claim 1, wherein the gable end walls each comprise a rounded formation substantially matched to the outward curvature of the first diverging wall at said gable-form part and tending to support that curvature against change.

6. A container according to claim 5, wherein said rounded formation is substantially oval.

7. A container according to claim 1, further comprising the second diverging wall having complementarily outwardly curved inner and outer surfaces substantially identical to the first diverging wall, with an edge thereof at the inside surface of the second diverging wall being curved and closely following the shape of that inside surface.

8. A gable-top carton sleeve comprising a bop of first, second, third and fourth substantially four-edged panels, each comprising a side wall part, a top closure obturating part and a top sealing fin part, wherein:— first and third obturating parts are substantially rectangular, second and fourth obturating parts each comprise three substantially triangular sub-parts of which two have boundaries with extents substantially co-extensive with extents of the respective first and third obturating parts and have other boundaries with extents substantially coextensive with the third substantially triangular sub-part, those of said substantially triangular sub-panels having boundaries substantially co-extensive with the first obturating part having their said other boundaries upwardly and outwardly curved, and wherein the first obturating part has a through hole for receiving a pour spout fitment.

9. A carton sleeve according to claim 8, wherein the second and fourth obturating parts further comprise a lower boundary line of weakness extending substantially thereacross.

10. A carton sleeve according to claim 9, wherein said lower boundary line of weakness is located at a level significantly below said through hole.

11. A carton sleeve according to claim 9, wherein the lower boundary line of weakness is downwardly curved.

12. A carton sleeve according to claim 9, wherein an end of the lower boundary line of weakness joins the other boundaries at the location spaced from the boundary with the first obturating part.

13. A carton sleeve according to claim 8, wherein the substantially triangular sub-parts have a rounded outline.

14. A carton sleeve according to claim 13, wherein said rounded outline is substantially oval.

15. A carton sleeve according to claim 8, wherein the second and fourth obturating parts are formed with respective arrays of radiating fold lines bounding the respective substantially triangular sub-parts.

16. A container comprising a semi-rigid sheet material and having a tubular main body and a gable-form part closing said body at one end thereof, said gable-form part comprising an outermost sealing fin, first and second diverging walls extending away from said fin, said first wall, at said gable-form part, being outwardly curved in an axial plane of said container, and gable end walls each extending from one to the other of said diverging walls and each comprise a rounded formation substantially matched to the curvature of said first wall at said gable-form part and tending to support that curvature against change, wherein the gable end walls further comprise a lower line of weakness extending substantially across a width of the gable end walls and forming a lower part of said gable-form part.

17. A container according to claim 16, wherein said rounded formation is substantially oval.

18. A carton sleeve comprising a bop of first, second, third and fourth substantially four-edged panels, each comprising a side wall part, a top closure obturating part and a top sealing fin part, wherein:

first and third obturating parts are substantially rectangular, second and fourth obturating parts each comprise three substantially triangular sub-parts of which two have boundaries with extents substantially co-extensive with extents of the respective first and third obturating parts and have other boundaries with extents substantially coextensive with the third substantially triangular sub-part, and said three substantially triangular sub-parts having a rounded outline.

19. A carton sleeve according to claim 18, wherein said rounded outline is substantially oval.

* * * * *